US008136272B2

(12) United States Patent
Hren et al.

(10) Patent No.: US 8,136,272 B2
(45) Date of Patent: Mar. 20, 2012

(54) DIPPER DOOR LATCH WITH LOCKING MECHANISM

(75) Inventors: William J. Hren, Wauwatosa, WI (US); Joseph J. Colwell, Hubertus, WI (US); Jeffrey S. Schwake, Milwaukee, WI (US); Bruce P. Kearsley, Gardnerville, NV (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 245 days.

(21) Appl. No.: 12/684,883

(22) Filed: Jan. 8, 2010

(65) Prior Publication Data

US 2010/0212194 A1 Aug. 26, 2010

Related U.S. Application Data

(63) Continuation-in-part of application No. 11/608,037, filed on Dec. 7, 2006, now abandoned, which is a continuation-in-part of application No. 11/457,141, filed on Jul. 12, 2006, now abandoned.

(60) Provisional application No. 60/698,797, filed on Jul. 13, 2005.

(51) Int. Cl.
*E02F 3/30* (2006.01)

(52) U.S. Cl. ..... 37/445

(58) Field of Classification Search ..... 37/444, 37/445, 398, 443, 379, 397, 442; 414/718, 414/719, 720, 724, 726, 723; 292/24, 95, 292/201, 216

See application file for complete search history.

(56) References Cited

U.S. PATENT DOCUMENTS

| | | | |
|---|---|---|---|
| 2,544,682 | A | 3/1951 | Hilgeman |
| 3,504,406 | A | 4/1970 | Schott |
| 3,805,528 | A | 4/1974 | Huebscher |
| 4,142,751 | A | 3/1979 | Varda |
| 4,254,974 | A | 3/1981 | Rolke et al. |
| 4,690,232 | A | 9/1987 | Schulz |
| 5,288,037 | A | 2/1994 | Derrien |
| 5,735,557 | A | 4/1998 | Harvey |
| 5,815,958 | A | 10/1998 | Olds et al. |
| 6,168,113 | B1 | 1/2001 | Hann et al. |
| 6,467,202 | B1 | 10/2002 | Brown, Jr. |
| 6,591,521 | B2 | 7/2003 | Brown |
| 2006/0249971 | A1 | 11/2006 | Ichinose |

OTHER PUBLICATIONS

Non-Final Office Action, U.S. Appl. No. 11/608,037, mailed Sep. 4, 2008.

Final Office Action, U.S. Appl. No. 11/608,037, mailed Jun. 10, 2009.

Advisory Action, U.S. Appl. No. 11/608,037, mailed Dec. 10, 2009.

*Primary Examiner* — Robert Pezzuto

(74) *Attorney, Agent, or Firm* — Michael Best & Friedrich LLP

(57) ABSTRACT

A dipper including a dipper door and an impact actuated jaw having a "C" shape defining a lip and a chin. The jaw is rotatably mounted on the dipper door for rotation between a door-opened position and a door-closed position and positioned so that when the jaw is in the door-opened position, the jaw chin can be impacted by the dipper body when the door pivots to the door-closed position. The dipper also includes a hold open mechanism for releasably holding the door latch in the latch open position when the latch is in the open position, and a locking mechanism for releasably locking the latch when the latch is in the door-closed position. The locking mechanism includes one bar pivotally attached to the door, and another bar pivotally connected to and extending between each of the one bar and the latch.

43 Claims, 20 Drawing Sheets

DIPPER DOOR LATCH WITH LOCKING MECHANISM

BACKGROUND OF THE INVENTION

The present invention relates to power shovels and, more particularly, to power shovels having a dipper adapted for excavating earthen material. Specifically, the present invention relates to latches for dipper doors.

Large electric mining rope shovels utilize a digging attachment consisting of a stationary boom with a combination handle/dipper structure which mounts on the boom and actively crowds and hoists into a bank in order to dig with and fill the dipper. The dipper is rigidly connected to the handle. After digging through a bank face and filling with material, the dipper is lifted and the upper portion of the shovel is rotated relative to the lower portion of the shovel so that the dipper is positioned above a waiting dump truck. The operator then activates a tripping mechanism that opens a dipper door latch on the bottom of the dipper and allows a door to swing down and open. The contents of the dipper are then dumped into the truck bed.

The heavy dipper door is pivotally mounted on a lower end of the dipper. The conventional mechanical latch mechanism secures the door in its closed position and, when released, allows the door to open under the force of gravity. The conventional latch mechanisms, as shown in FIGS. 2 and 3, typically include a trip wire 1 or cable assembly which has one end adapted for control by a power shovel operator and another end connected to a moveable latch lever 2 which is generally located on the dipper door 3. The latch lever is typically coupled to a slidable rod or latch bar 4 that is selectively engaged in a latch keeper opening 5 (see FIG. 3) in a front wall 6 of the dipper body of the dipper. The dipper door 3 is held closed when the latch bar 4 is within the latch keeper opening 5. The dipper door is caused to open by tripping the trip cable 1 which moves the latch lever 2 which causes the latch bar 4 to slide away from the latch keeper opening 5 and disengage the latch keeper opening 5, whereby the dipper door 3 will open under its own weight plus the weight of any material contained within the dipper body. The latch lever 2 provides significant mechanical leverage to slide and pull the latch bar 4, which is under very high load.

Normally, the door is thereafter closed by swinging the dipper in such a direction so as to cause the dipper door to move by inertia towards its closed position until the latch bar reengages the latch keeper. More particularly, the latch bar is forced away from the dipper front wall by contacting the latch keeper wall with a sloping surface that causes the latch bar to push up, and then the latch bar drops into the slot by gravity, locking the door.

This is a simple device including mainly two bars pulling on each other with dry, sliding friction contact that has worked well for many years; however, with the increase in dipper size over the past few years, its reliability has become compromised because dry sliding friction levels have increased under higher contact loads making behavior less predictable.

There are maintenance problems with this system, especially when it is used with 100-ton or larger payload dippers. Latch bars and related operating equipment are a significant part of dipper maintenance cost.

The maintenance problems include broken pull chains and clevis. The pull chain is the chain that connects a tugger rope to the latch bar lever. The trip ropes have to be replaced constantly as they become frayed and strands break. The snatch block (sheave) and bracket of the trip mechanism break or have to be replaced on a regular basis. The tugger motor, gearing and drum take a continuous beating causing repeated failures. And lastly, the latch bar has to have shimming added, and this is a constant ongoing maintenance issue that in the long run becomes labor intensive and costly.

The amount of tension required to trip or move a latch bar on a fully loaded 120-ton payload dipper nearly exceeds the mechanical ability of this system. Larger motors are usually the solution, but the net result is a very high cost maintenance area.

Another problem with conventional mechanical latch closure mechanisms is the tendency for such mechanisms to quickly wear out and require replacement in only a short period of time. Each time the slidable latch bar engages the latch keeper or the like, the tip of the slidable latch bar naturally wears down. In many conventional latch mechanisms, the slidable latch bar is only moved about a half inch to about an inch in order to allow the dipper door to open. Thus, only a very small portion, i.e., the tip, of the slidable latch bar comes into contact with the latch keeper. Since the latch bar is under very high load and the contact area is very small, the tip experiences very high contact forces that cause an accelerated rate of wear. As the tip of the slidable latch bar wears down over time, it becomes possible for the dipper door to prematurely open before the power shovel operator is ready for the dipper door to open. This, as can be appreciated by those skilled in the art, can create a hazardous and unsafe condition if the power shovel is not properly maintained.

To account for this wear, the latch bar length of engagement with the latch keeper must be frequently adjusted by adding or removing shims to the latch lever pivot mechanism 6 (see FIG. 2). This requires the lifting of the heavy latch lever and latch bar to insert and remove the shims, usually with the assistance of a crane or forklift. Thus, conventional latch closure mechanisms exhibit operational shortcomings that must be addressed with more frequent, hazardous, and costly maintenance activities.

Examples of other past dipper latch approaches include Hilgeman U.S. Pat. No. 2,544,682 that illustrates a pivoting latch with a primary locking mechanism and a secondary latch, and Brown Jr. U.S. Pat. No. 6,467,202 that illustrates a dipper door pivoted and held by a linkage mechanism.

BRIEF SUMMARY OF THE INVENTION

One object of the invention is to provide a new system that is less maintenance intensive.

Another object of the invention is to provide a new dipper door latch system that does not require replacement after a short amount of time.

Another object of the invention is to provide a dipper door latch mechanism that will eliminate almost all dry sliding contact surfaces by replacing translational sliding motion with rotational motions.

Another object of the invention is to provide a dipper latch mechanism that replaces the dry sliding latch bar approach with a new rotational door latch where there are no members that see high loads and dry sliding friction at the same time. Dry sliding friction is replaced with greatly decreased lubricated rotational friction. Members rotate relative to each other and the dipper but the rotation does not take place while undergoing high loads.

Another object of the invention is to provide a dipper latch mechanism that will latch with high reliability even when there is a "soft" impact between the dipper door and the dipper body.

Another object of the invention is to provide a dipper latch mechanism that will usually unlatch only when the operator wants to unlatch, avoiding any false and unwanted trips.

This invention provides a dipper including a dipper door and an impact-actuated jaw having a "C" shape defining a lip and a chin. The jaw is rotatably mounted on the dipper door for rotation between a door-opened position and a door-closed position and positioned so that when the jaw is in the door-opened position, the jaw chin can be impacted by the dipper body when the door pivots to the door-closed position. The dipper also includes a hold open mechanism for releasably holding the door latch in the latch open position when the latch is in the open position, and a locking mechanism for releasably locking the latch when the latch is in the door-closed position.

In one embodiment, the locking mechanism includes one bar pivotally attached to the door, and another bar pivotally connected to and extending between each of the one bar and the latch.

Other features and advantages of the invention will become apparent to those skilled in the art upon review of the following detailed description, claims and drawings in which like numerals are used to designate like features.

Figure 1:
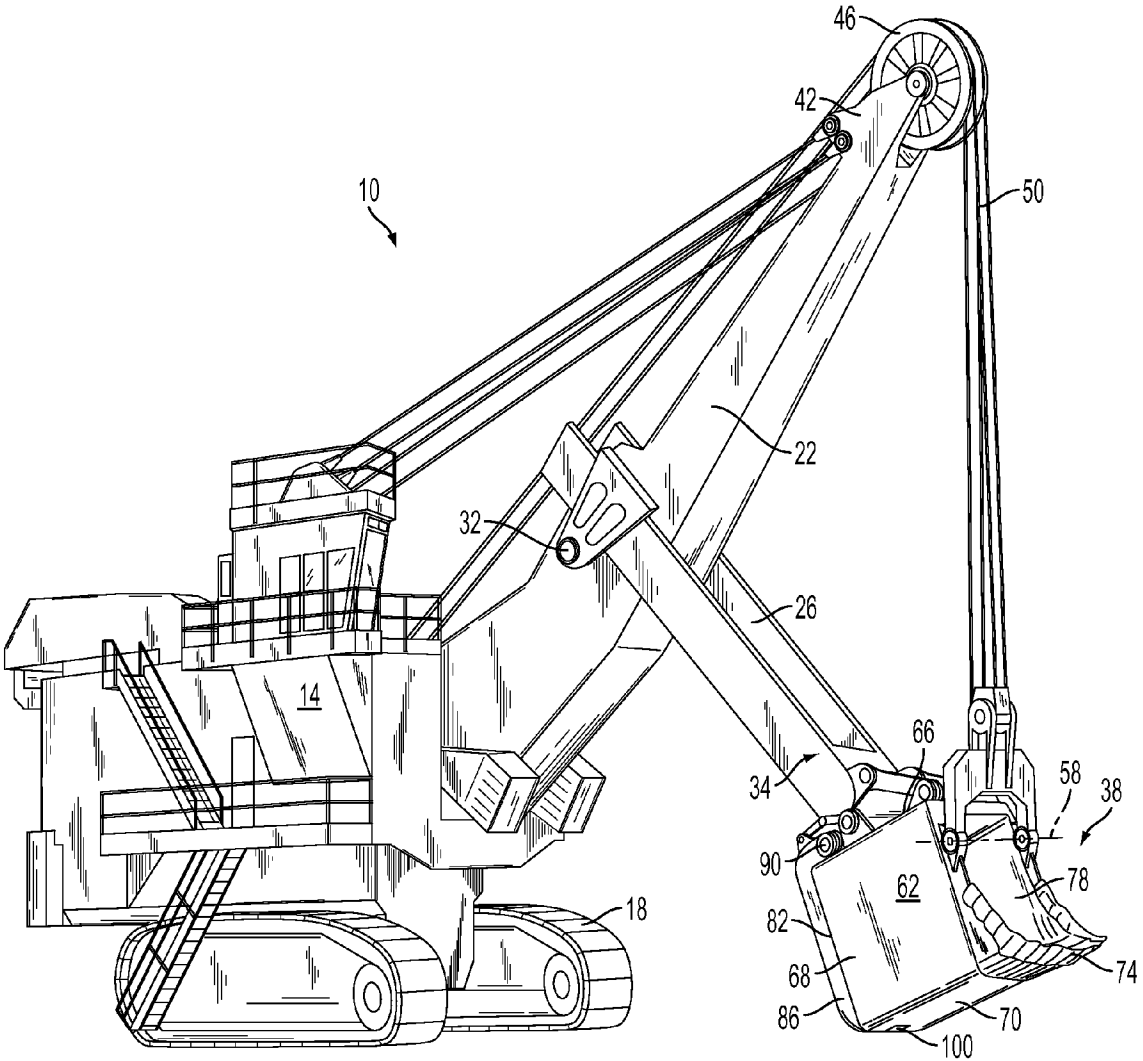
FIG. 1 is a side elevational view of a power shovel embodying the present invention.
Figure 2:
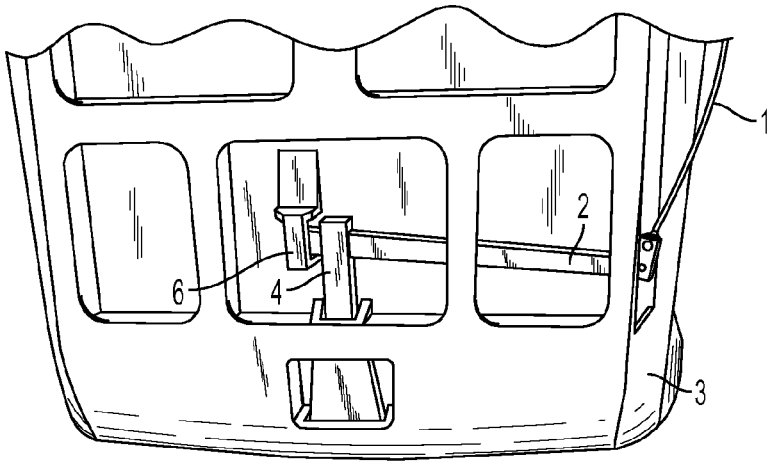
FIG. 2 PRIOR ART
FIG. 2 is a bottom view of a prior art dipper with a latch assembly to open and close a dipper door of a dipper.
Figure 3:
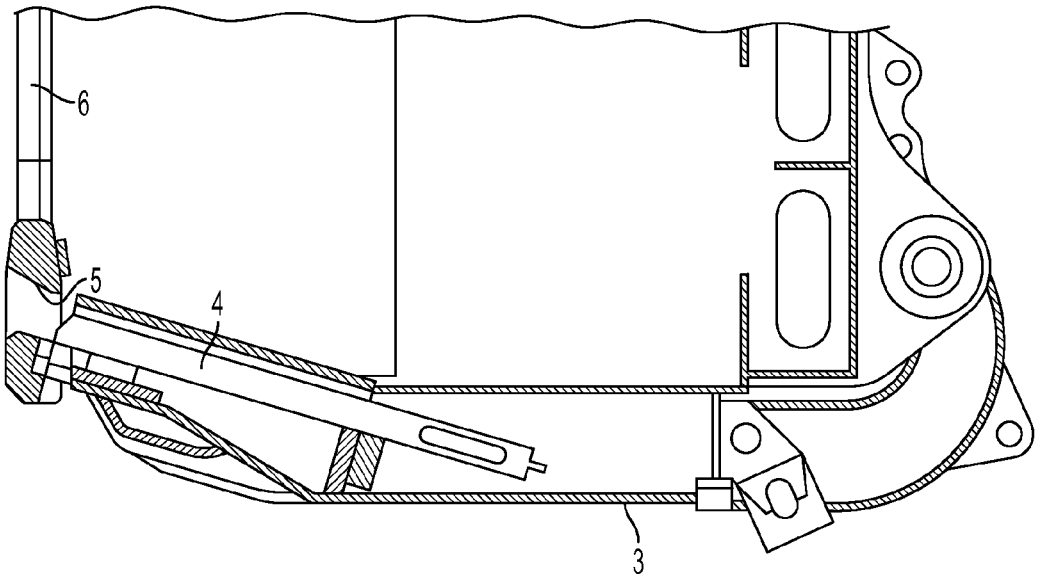
FIG. 3 PRIOR ART
FIG. 3 is a side cross sectional view of the prior art latch assembly shown in FIG. 2, illustrating how the prior art latch slides into the latch keeper.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENTS

Illustrated in FIG. 1 is a power shovel 10 embodying the present invention. It should be understood that the present invention is capable of use in other power shovels known in the art and power shovel 10 is only provided as an example of one such power shovel. The power shovel 10 comprises a frame 14 supported for movement over the ground. Specifically, frame 14 is a revolvable upper frame mounted on a mobile base such as crawler tracks 18. A fixed boom 22 extends upwardly and outwardly from the frame 14. A dipper handle 26 is mounted on the boom 22 for movement about a rack and pinion or crowd drive mechanism (not shown) for pivotal movement relative to the boom 22 about a generally horizontal dipper handle axis 32, and for translational (non-pivotable) movement relative to the boom 22. The dipper handle 26 has a forward end 34. A dipper 38 is mounted on the forward end 34 of the dipper handle 26 in a conventional manner. An outer end 42 of the boom 22 has thereon a sheave 46, and a hoist cable or rope 50 extends over the sheave 46 from a winch drum (not shown) mounted on the frame 14 and is connected to the dipper 38 for pivotal movement relative thereto about a horizontal pivot axis 58.

The dipper 38 is generally of a box shape having a body 62 which includes a back wall 66, opposite side walls 68 extending forwardly from and substantially perpendicular to the back wall 66, and a front wall 70 which is generally parallel to the back wall 66. In other embodiments (not shown), other dipper body shapes can be used. Digging teeth 74 extend outwardly from an upper end of the front wall 70. The main body or dipper body 62 defines a material receiving opening 78 and a material discharging opening 82. The dipper 38 further includes a dipper door 86 pivotally connected to the back wall 66 adjacent the lower end thereof about a dipper door axis 90. The dipper door 86 is movable between opened and closed positions, as will be further described below. The back wall 66 of the dipper 38 is connected to the forward end 34 of the dipper handle 26. The back wall 66 (and thus the dipper 38) is rigidly connected to the dipper handle 26.

Figure 6:
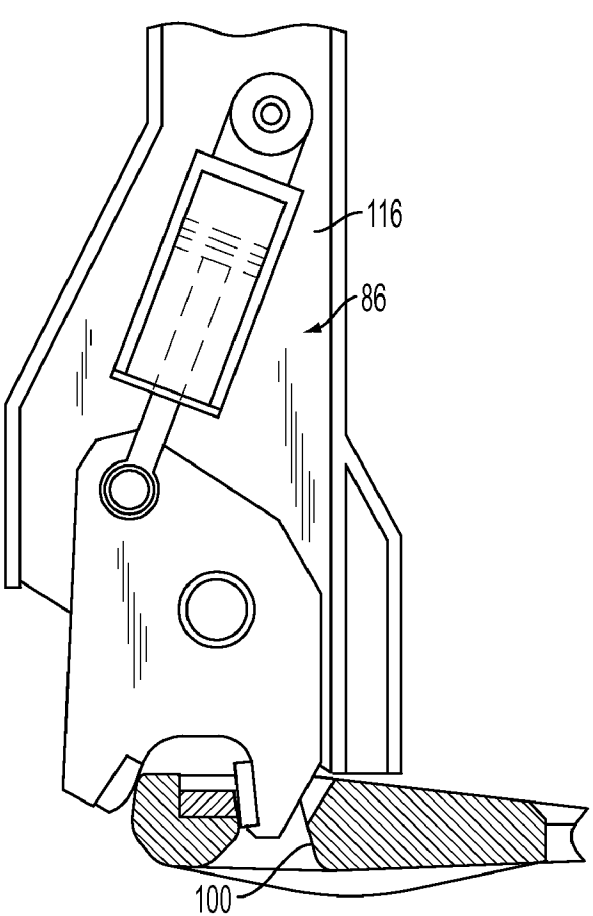
FIG. 6 is a partial cross sectional view of the latch assembly and latch keeper of this invention with the dipper door closing.
Figure 5:
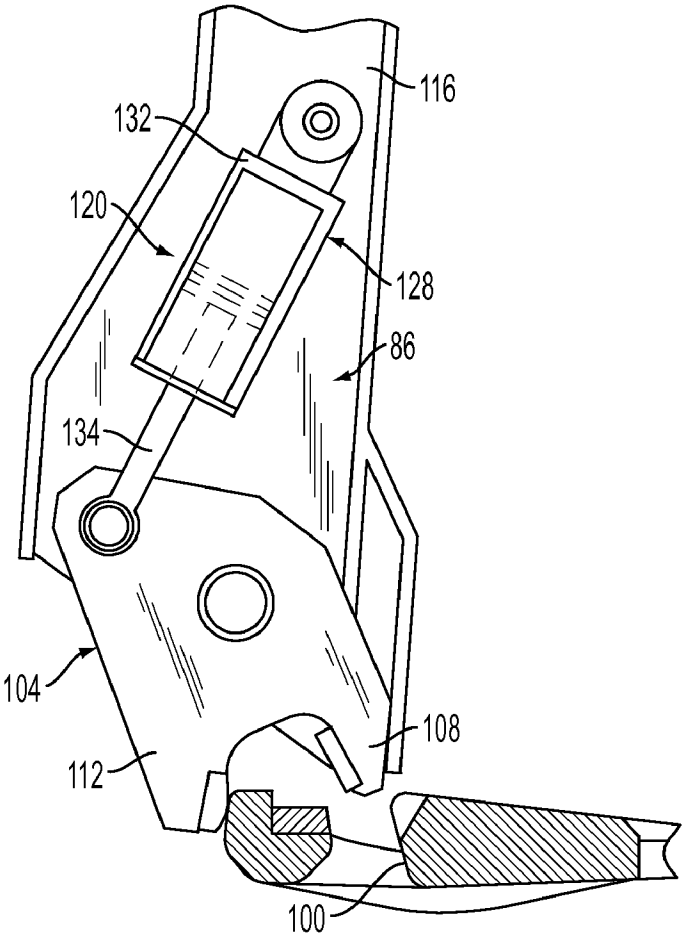
FIG. 5 is a partial cross sectional view of the latch assembly and latch keeper of this invention with the dipper door opening.

As further explained below, FIGS. 1, 5 and 6 illustrate how the dipper body 62 also has a latch receiving opening 100 adjacent one end of the discharging opening 82.

Figure 8:
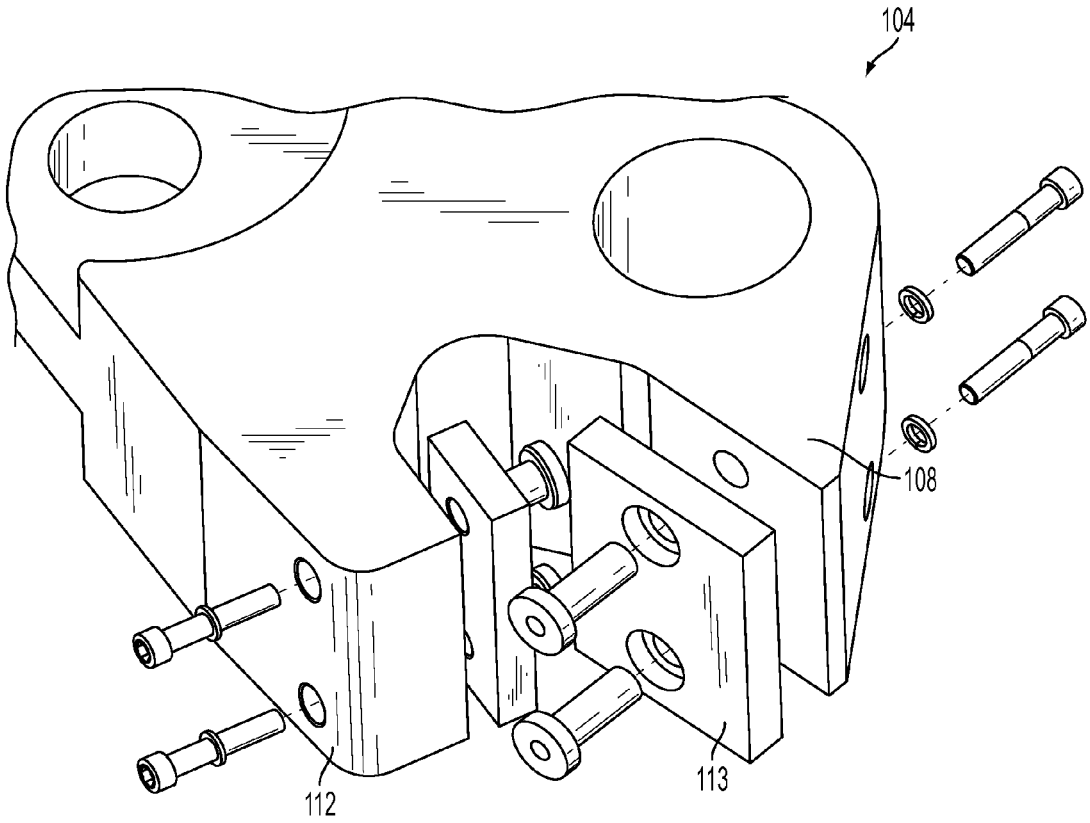
FIG. 8 is a partial exploded perspective view of the jaw of the latch assembly of this invention.

In order to keep the door 86 in its closed position until it is desired to open the door 86 to drop the dipper's contents, the dipper 38 includes an impact actuated latch 104 in the form of a jaw having a "C" shape, as shown in FIGS. 4, 5, 6 and 8, thus defining a lip 108 and a chin 112. Each of the lip 108 and chin 112 can incorporate a removable wear plate 113, as shown in FIG. 8. The jaw 104 is pivotally, and more particularly, rotatably mounted on the dipper door 86 for rotation between a door-opened position (FIG. 5) and a door-closed position (FIG. 6). Further, the jaw 104 is positioned so that when the jaw 104 is in the door-opened position, the jaw chin 112 can be impacted by the dipper body 62 when the door 86 pivots to the door-closed position, and so that impact by the dipper body 62 on the chin 112 rotates the jaw 104 into the door-closed position where the jaw lip 108 is in the latch opening 100 and prevents door opening. In other words, the jaw lip 108 is out of the way of the dipper body 62 when the jaw 104 is in a door-opened position, as shown in FIG. 5.

Figure 4:
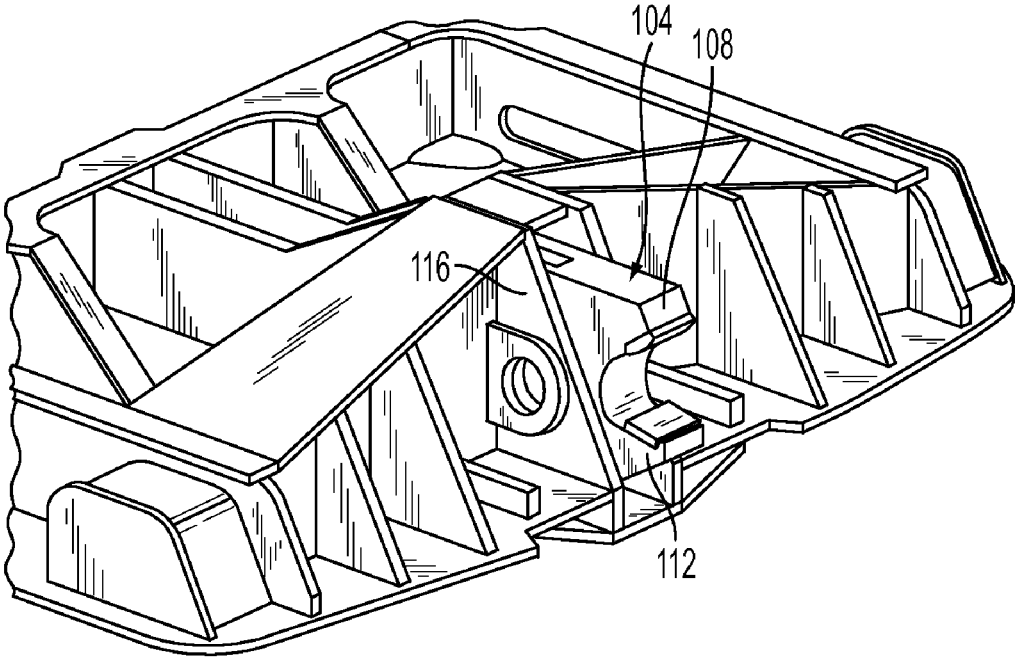
FIG. 4 is a perspective view of part of the bottom of the dipper door and the latch assembly of this invention.

More particularly, as shown in FIG. 4, the dipper door 86 includes spaced apart structural support ribs 116, and the jaw 104 is rotatably mounted between two of the support ribs 116. In other less preferred embodiment, a simple bar latch (not shown) can be used that rotates into and out of the latch receiving opening 100.

The dipper 38 further includes a hold open mechanism 120 for releasably holding the jaw 104 in the door-opened position when the jaw 104 is in the open position, and a locking mechanism 124 for releasably locking the jaw 104 when the jaw 104 is in the door-closed position. When the locking mechanism 124 is released, the latch 104 rotates open as a result of the weight of the door 86 and the material pushing against the dipper door 86.

First Embodiment

Figure 7:
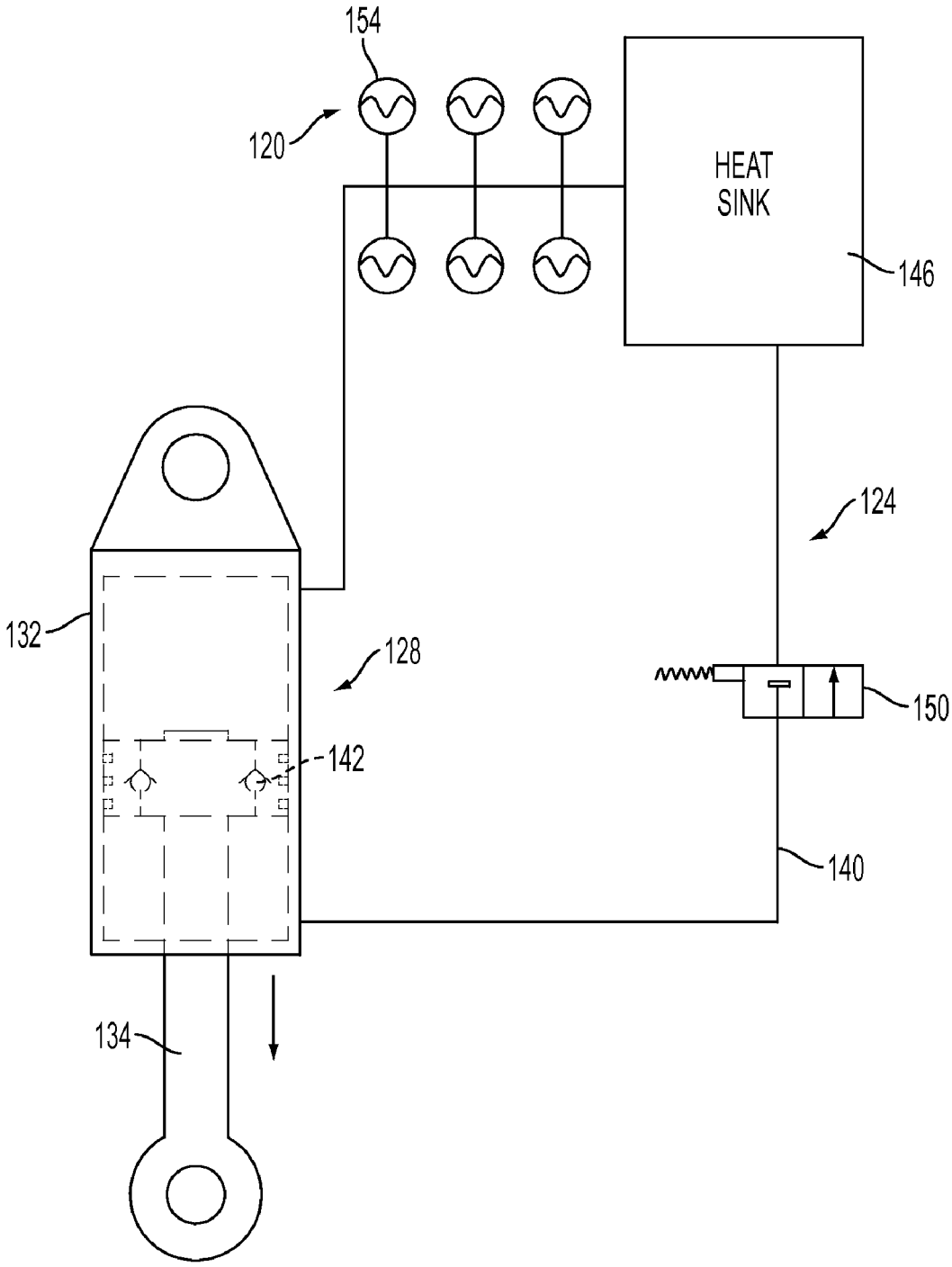
FIG. 7 is a schematic illustration of the hydraulic circuit of this invention.

In one embodiment, as illustrated in FIGS. 5, 6 and 7, the hold open mechanism 120 and locking mechanism 124 is a hydraulic cylinder assembly 128 pivotally attached to and extended between the dipper door 86 and the latch 104. More particularly, as illustrated in FIGS. 5 and 6, the hydraulic cylinder assembly 128 is pivotally attached at one end to between two of the support ribs 116.

The hydraulic assembly 128 is provided with a hydraulic cylinder 132 and a piston 134 that is movable within the hydraulic cylinder 132. The piston 134 divides the hydraulic cylinder 132 into a first chamber and a second chamber wherein the volumes of the chambers change as the piston 134 moves back and forth within the hydraulic cylinder 132. Either the hydraulic cylinder or the piston can be connected to the latch and the other connected to the dipper door 86.

More particularly, in this embodiment (as shown in FIG. 7), the hold open mechanism 120 and locking mechanism includes a closed loop hydraulic circuit 140 including at least one check valve 142, a heat sink 146, a locking valve 150 and at least one accumulator 154. In this embodiment, there are two check valves 142, and they are incorporated into the piston 134. The accumulators 154 are used to maintain pressure and accommodate the volume differences between the top (shaft) and bottom (open) portions of the cylinder 132.

The locking valve 150 controls the hydraulic fluid flow through the conduit from one of the chambers to the other chamber. In this way, when the valve 150 is closed, the hydraulic fluid is prevented from flowing between the chambers so that the latch 104 remains locked and the dipper door 86 is prevented from moving. When the valve 150 is opened, the hydraulic fluid is allowed to flow between the chambers and the dipper door 86 is allowed to move.

Preferably, the valve 150 is a solenoid valve that is controlled by way of a remote switch (not shown) operated by the power shovel operator. Such valves are commonly known to those skilled in the art and are also readily available from numerous commercial sources. Power can be supplied by a 24V rechargeable battery pack mounted in the top of the dipper door 86 and activated by an RF signal. Another method would be to mount a cable take-up reel on the boom and attach the cable to the top of the door. This would allow the control valve 150 to be hard wired.

When the dipper door 86 is latched the jaw 104 is biased to rotate to release from the latch opening 100 by the pressure difference in the cylinder assembly 128 caused by the greater area in the non-rod end of the cylinder 132, but is held in place by the control valve 150. And the hold open mechanism 120 comprises the at least one accumulator 154 that provides the residual pressure that extends the cylinder assembly 128 to its maximum extension. Any excessive heat is accounted for through the heat sink 146.

In operation, when the door 86 slams shut, the hydraulic cylinder assembly 128 will be displaced transferring fluid through its piston 134 via the series of internal check valves 142. Once engaged, the piston 134 is fully retracted. The cylinder assembly 128 cannot extend, due to the hydraulic lock. And the cylinder assembly 128 is under tension when the jaw 104 is engaged.

Second Embodiment

Figure 9:
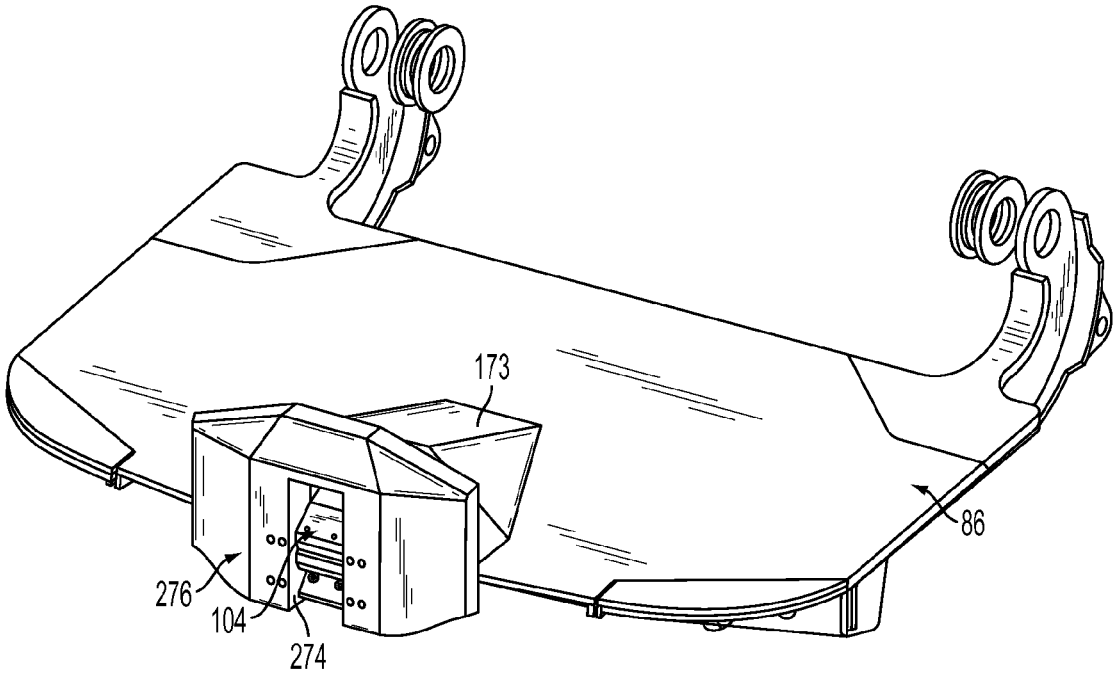
FIG. 9 is a perspective view of the dipper door and latch keeper of this invention.
Figure 10:
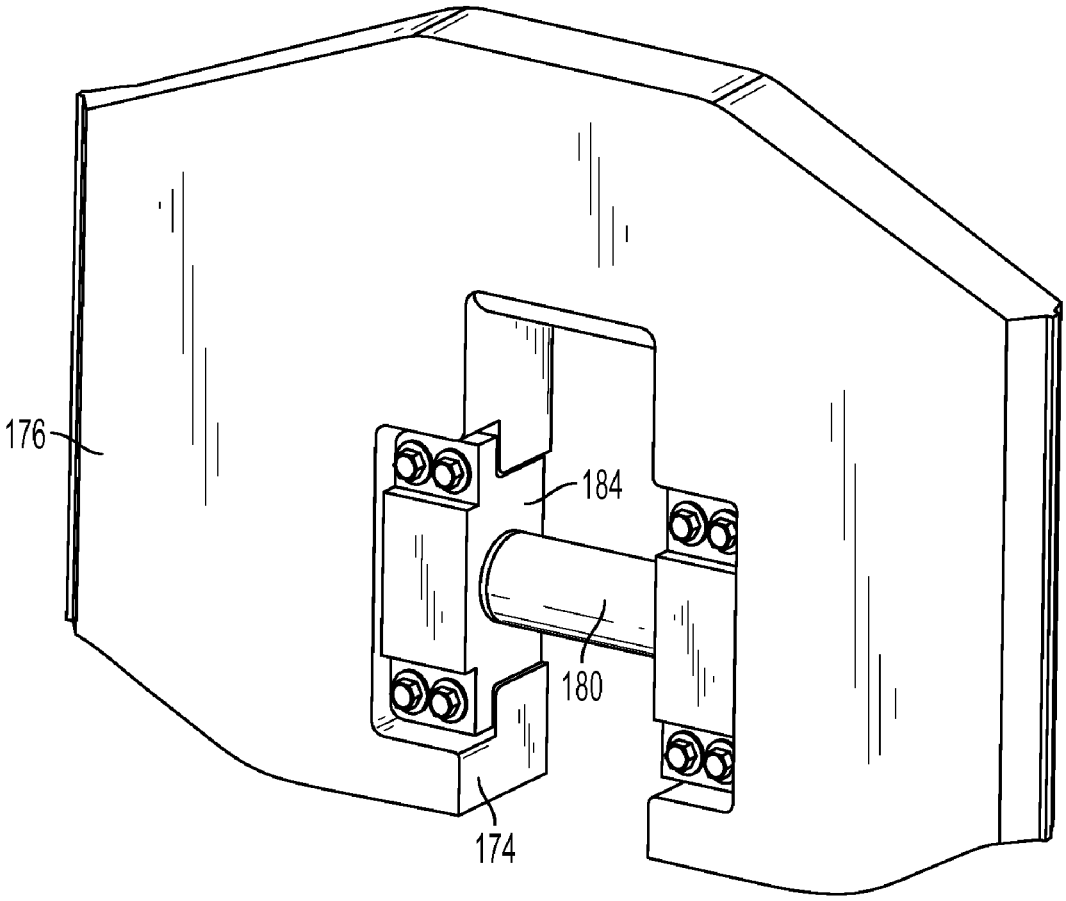
FIG. 10 is a perspective view of the latch keeper of this invention.
Figure 11:
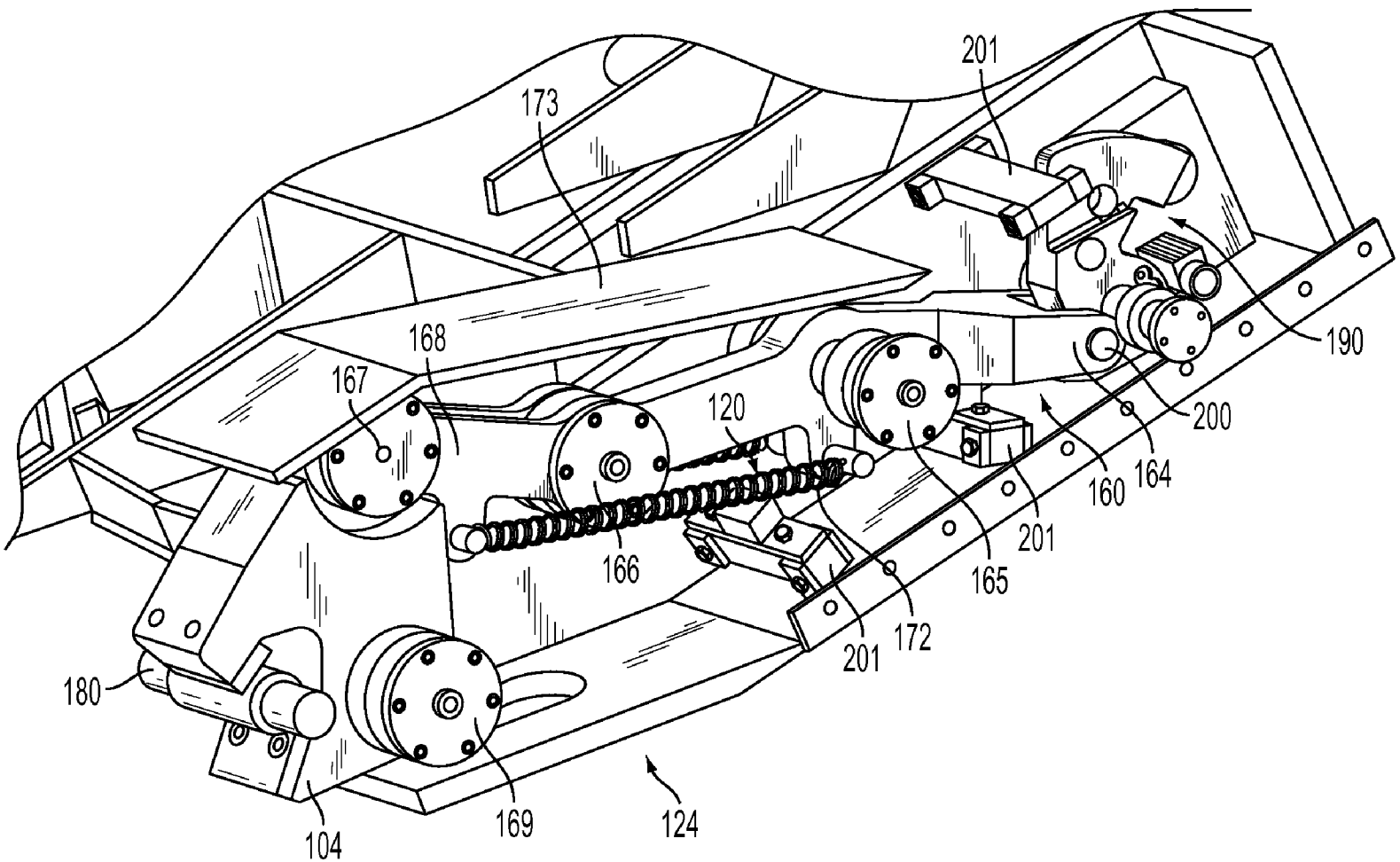
FIG. 11 is a partial broken away side perspective view of another embodiment of the latch mechanism of this invention, with the latch in a door-closed position.
Figure 12:
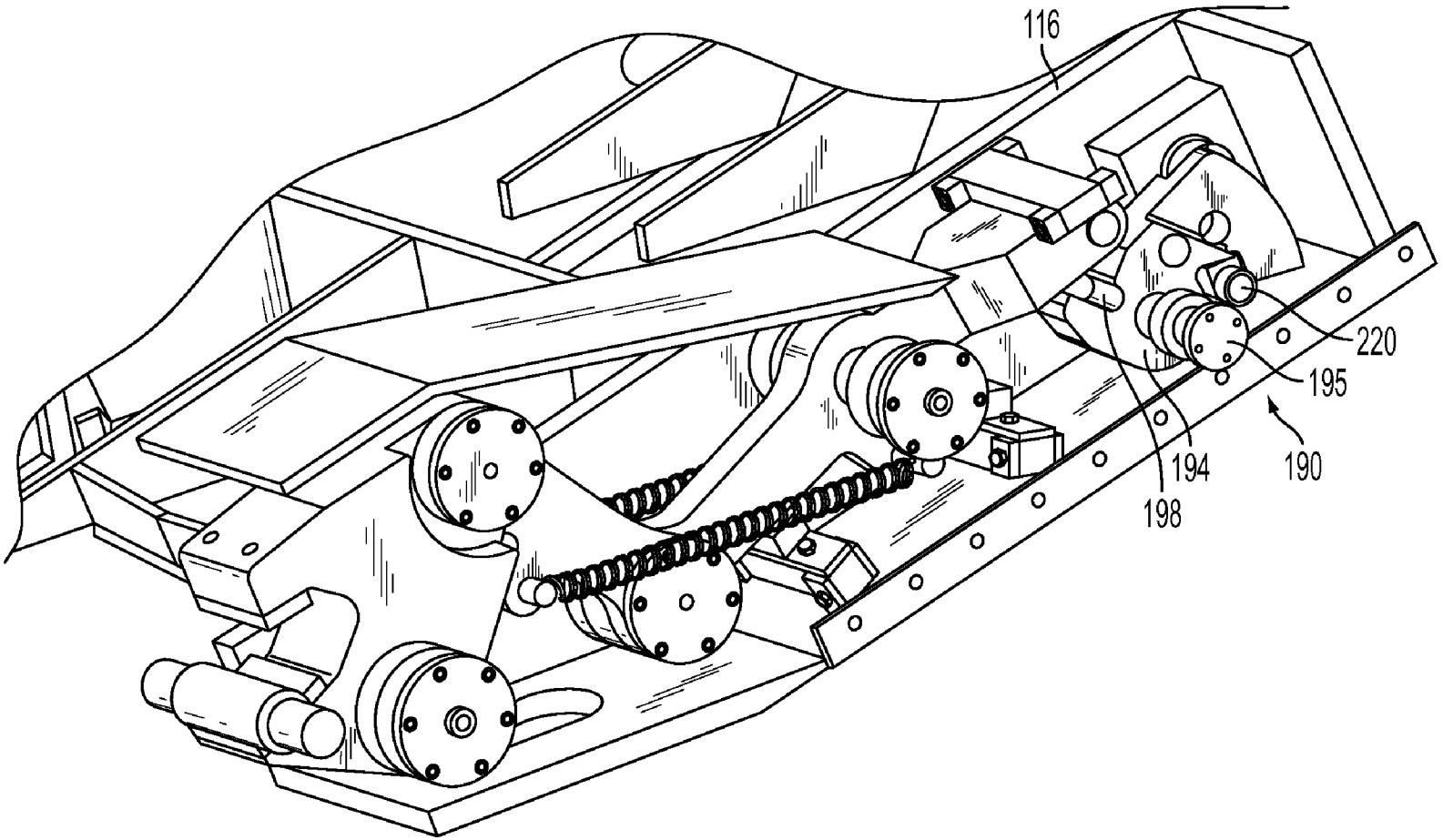
FIG. 12 is a partial broken away side perspective view of the embodiment of the latch mechanism shown in FIG. 11, with the latch in a door-opened position.

In another and more preferred embodiment, which is shown in FIGS. 9 through 16, like numerals identify items described previously. As illustrated in FIGS. 11 and 12, the locking mechanism 124 in this embodiment includes a primary locking mechanism 160 including one bar 164 pivotally attached at 165 to the door 86, and another connecting bar 168 pivotally connected to and extending between each of the one bar 164 at 166 and the latch 104 at 167. The jaw 104 is pivotally connected to the door 86 at 169. Further, the hold open mechanism 120 in this embodiment is means biasing the latch 104 into its open position in the form of a spring 172 attached between the one bar 164 and the connecting bar 168. More particularly, in this embodiment, there is one spring 172 on one side of the one bar 164 and the connecting bar 168 and a similar spring (see FIG. 12) on the opposite side of the one bar 164 and the connecting bar 168. When locking the locking mechanism 124, the pivot connection between the one bar 164 and the connecting bar 168 travels through the spring 172, which helps to drive the latch 104 into the locked position and hold the latch 104 closed, as further explained below. The latch 104, the springs 172 and the locking mechanism 124 are located between two of the support ribs 116 (only one of which is shown in FIGS. 11 and 12), and are protected by a protective cover 173.

In this embodiment, as illustrated in FIGS. 9 and 10, the latch opening or keeper 100 in the dipper body 62 is in the form of a cutout 174 formed in a striker plate 176 that is a part of, such as by being welded, the dipper body front wall 70. A striker bar 180 extends across the cutout 174 parallel to the plane of the dipper discharging opening 82, the latch receiving opening being defined by the striker bar 180 and the striker plate 176. The jaw chin 112 impacts the striker bar 180.

The dipper striker bar 180 serves the important purpose of anchoring the dipper door 86 to the dipper body 62 through the latch link engagement. The construction of the striker bar 180 is a round pin, and the pin is allowed to rotate under load because it has bushed supports 184. This is significant because sliding friction between the latch 104 and the striker bar 180 is eliminated. In addition, the large contact load between the latch 104 and the striker bar 180 is relieved instantly when the door is unlatched. That is, there is no constant high and dry contact load acting over a significant length like there is in a sliding friction door latch. Shims (not shown) can be placed between the supports 184 and the cutout 174 to adjust the position of the striker bar 180, when desired.

The rotatable latch jaw 104 that acts as the forward link of this four bar primary locking mechanism 124, rotates and curls around a striker bar 180 when the chin 112 of the latch 104 strikes the dipper striker bar 180 upon door re-latch. The tension springs 172 are positioned such that the rotatable latch 104 is driven with extra rotational impetus to provide a controlled and positive re-latch. Re-latch is achieved in this manner as the latch jaw 104 curls around the striker bar 180 and is positively held in that position by the locking and holding power of the primary locking mechanism 160.

The various pivot points in the primary locking mechanism 160 have the added advantage in that they can be lubricated with the lubricant held locally in place with pin retention systems. Also, these pin joints can be lined with replaceable bronze bushings to protect the parent linkage material.

The mechanism remains in the unlatched, collapsed condition thanks to the springs 172 that effectively control and hold the mechanism bars or links in the door-opened position as long as the door 86 is unlatched. The springs 172 also prevent the latch jaw 104 from extending back into the latched position, for if the latch jaw 104 were in the latched position, the latch jaw 104 would not be in the proper position to permit the door to shut again. As the empty shovel dipper 38 is lowered and swung backward to start a new dig cycle, the dipper 38 with the dipper body strike bar 180 swings into the hanging dipper door 86, so that the bottom portion or chin 112 of the jaw strikes the dipper body striker bar 180 and is driven back into the closed position. The springs 172 again serve their dual purpose because the springs now act to drive the latch 104 into engagement as the jaw 104 curls around the striker bar 180.

Figure 13:
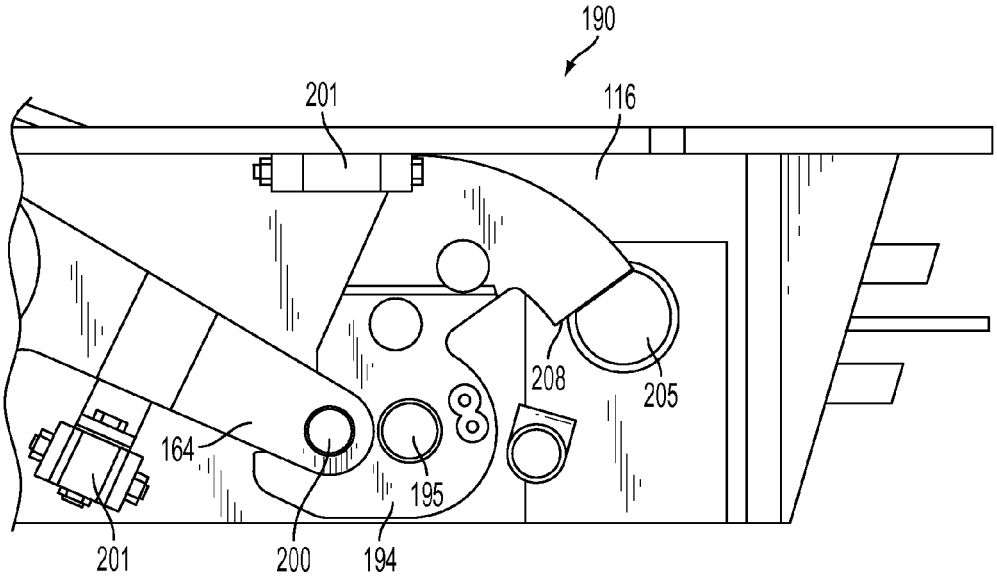
FIG. 13 is a side view of the secondary latch mechanism of the latch mechanism shown in FIGS. 11 and 12, with the secondary latch in a bar holding position.
Figure 14:
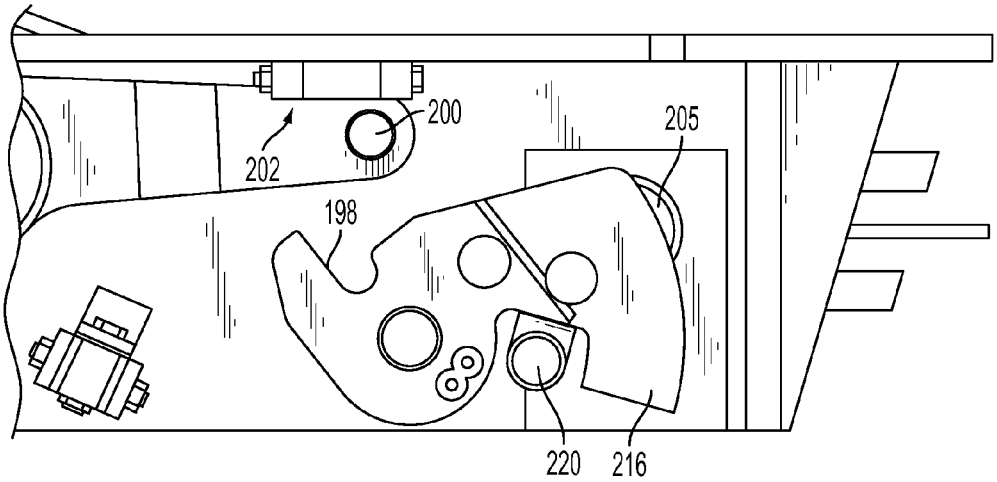
FIG. 14 is a side view of the secondary latch mechanism of the latch mechanism shown in FIGS. 11 and 12, with the secondary latch in a bar released position.

In order to lock the locking mechanism 124, the locking mechanism also includes a secondary latch 190, as illustrated in FIGS. 11 through 15 and 17. The secondary latch 190 is under much less load but controls the engagement of the primary latch 104 holding the dipper door 86 to the dipper body 62. The secondary latch 190 comprises a bar holder 194 pivotally mounted at 195 on the dipper door 86, the bar holder having a bar holding indentation 198, the indentation 198 receiving the one bar end or tail 200 and preventing movement of the one bar end 200 when in a bar holding position (FIG. 13) and permitting movement of the one bar end 200 when in a bar releasing position (FIG. 14). The locking mechanism 124 is locked by impact of the one bar end or tail 200 into the secondary latch bar holder 194, and movement of the bar holder 194 into the bar holding position, as further explained below.

When the dipper door is latched and under heavy load due to the material within the dipper, the primary latch mechanism is under heavy load and the bars want to collapse so the latch wants to disengage the dipper striker bar allowing the door to open. This tendency of disengagement exists because the four bar linkage approaches the toggle but is held by mechanical stops 201 and by the secondary latch 190 to be about 7 degrees short of toggle. The "tripping" or unlocking of the secondary latch 190 allows the bars of the primary locking mechanism 160 to collapse and the latch jaw 104 to rotate out of engagement with the body 62.

Figure 15:
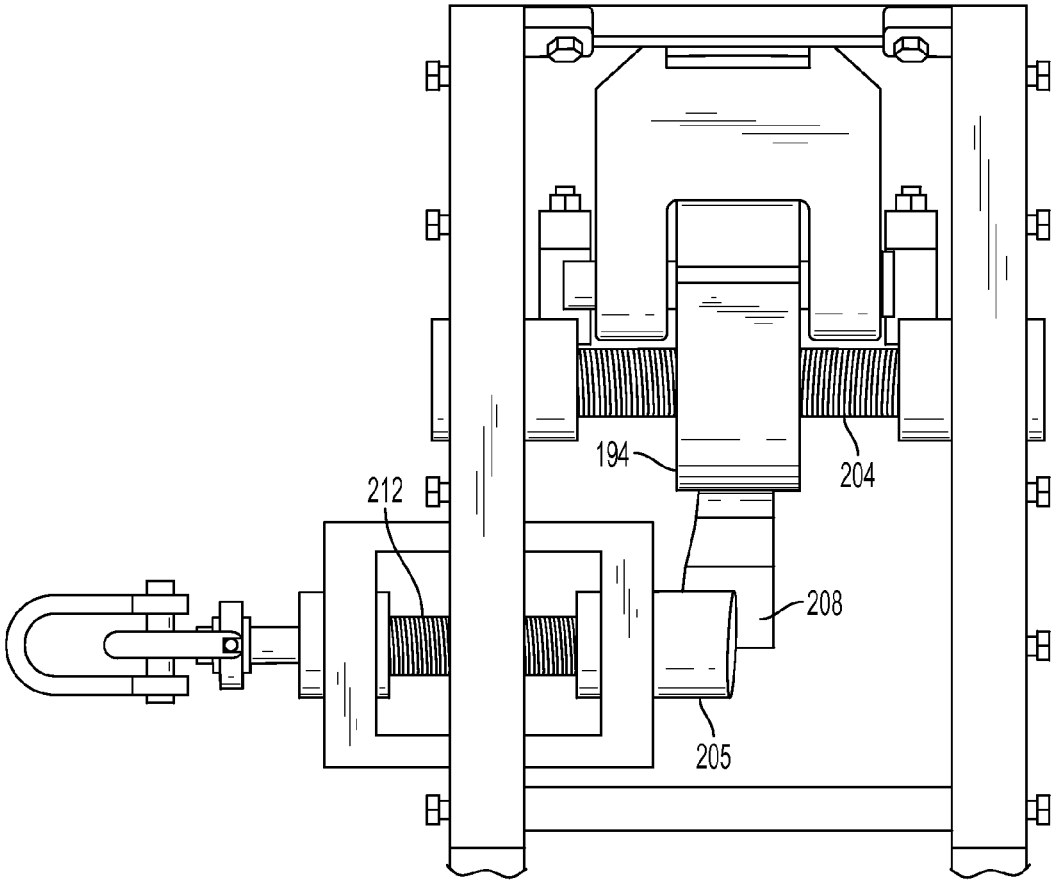
FIG. 15 is a bottom view of the locked secondary latch mechanism shown in FIG. 13, with the bumper stop 220 removed.
Figure 16:
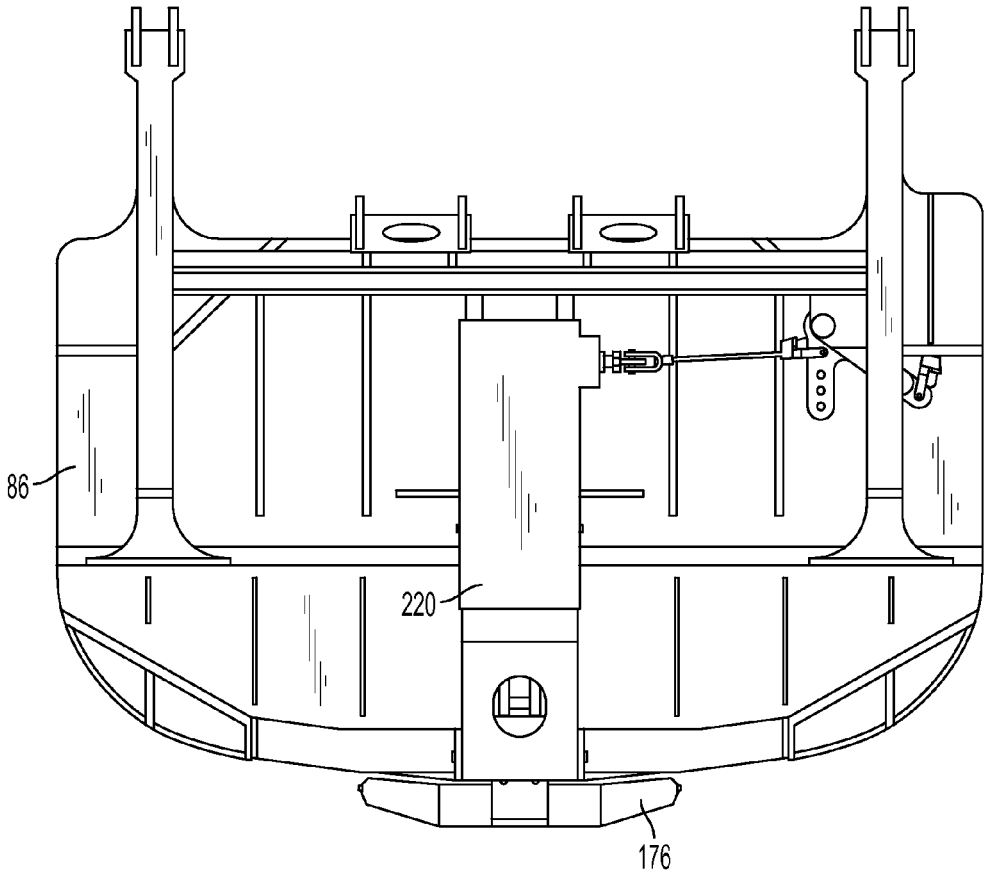
FIG. 16 is a bottom view of the dipper door of this invention.
Figure 17:
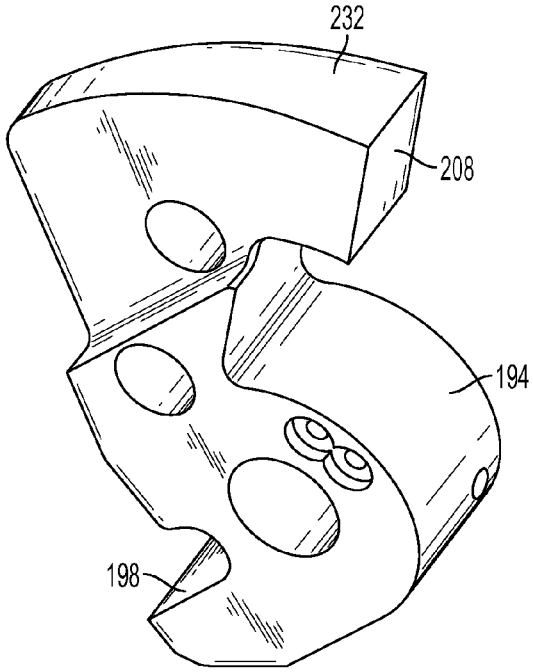
FIG. 17 is a perspective view of the bar holder 194 in FIG. 13.

As best illustrated in FIG. 15, the bar holder 194 is biased by a weak spring 204 toward the bar releasing position (see FIG. 14) but is held in locked position by a plunger 205 that engages an end 208 (see FIG. 13) of the bar holder 194. The plunger 205 slips into the bar holding position when the secondary latch moves into the bar holding position, as shown in FIGS. 13 and 15. The plunger 205 is biased toward the bar holder 194 by a strong compression spring 212 (see FIG. 15.

When the bar end 200 strikes the bar holder 194 on its way to the latch position, the weak spring 204 allows the bar holder 194 to rotate into a position to "catch" the bar end 200 in the latched position in the indentation 198 of the holder 194. If the bar holder 194 travels past its bar holding position, the weak spring 204 brings the bar holder end 208 back into engagement with the plunger 205. As the bar holder 194 rotates to its latched position, the bar holder has an inclined surface 232 (see FIG. 17) that engages the end of the plunger 205. The bar end 200 striking the bar holder 194 drives the bar holder end 208 to forcibly push the trip plunger 205 out of the way. The bar holder end 208 then over travels slightly to allow the trip plunger 205 to extend under force of the torsion spring 212 to thereby prevent the bar holder end 208 from any rotational movement that would unlatch the locking mechanism 124. The trip plunger 205 therefore locks the secondary latch 190, which in turn locks the primary latch 160.

This weak spring 204 effect guarantees a successful latch even when the latching force is very small, thus giving the locking mechanism 124 a "soft latch" feature. The soft latch feature is desirable because the shovel operator does not have to deliberately try to slam the door shut for a successful door latch. The strong spring 212 on the trip plunger 205 is stiff enough to resist inadvertent inertial loads on the trip cable. This helps to eliminate unintended false trips due to cable slack take up when the dipper handle is suddenly extended or retracted. The stiff spring, however, can be overcome by the very deliberate operator act of tripping the cable via cable pull from a motor driven drum.

In operation, the latch jaw 104 is held in the latched position by the secondary latch 190 that holds onto the tail end 200 of the primary locking mechanism 160 until the operator trips the secondary latch 190. The primary locking mechanism extends to a position just short of a full toggle position. As a result, the mechanism wants to collapse away from the toggle position under gravity. The secondary latch prevents it from doing so and the door is locked.

The instant the latch jaw 104 curls around the striker bar 180, the secondary latch 190 grabs the tail 200 of the one bar 164 and keeps the locking mechanism 124 from collapsing again until the operator trips the secondary latch 190. The impact is not considered great during routine shovel digging but the momentum of the heavy door and dipper drive the relatively light linkage to the latched position just in time for the dipper to start a new dig cycle through a bank of material.

The secondary latch mechanism can take on many different mechanical configurations (not shown) and can be triggered by many different methods including pneumatic, hydraulic, electromagnetic solenoid, and mechanical cable pull. In the preferred embodiment, the secondary latch plunger 205 is remotely triggered with an RF signal, as is done with a garage door opener. This eliminates all maintenance intensive trip motors, trip cables, and cable pulleys.

The fixed pivot location of the secondary latch is located directly above and in line of the bar indentation 198 that holds the bar end 200 in the latched position. As long as this position holds, or that the indentation is somewhat to the right of this line of action, then the latch will not rotate and is locked in place. The end 216 of the bar holder 194 opposite the end with the bar indentation 198 engages a mechanical stop in the form of a bumper stop 220 and insures the bar indentation 198 is in the proper position to receive the bar end 200. The bar holder 194 will press against this bumper because of torsional tension supplied by the spring 204.

Rotation of the secondary latch is limited in the latching position by the bumper stop 202. The stop 220 is located precisely in a position to allow the bar holder 194 to over travel slightly to allow the trip plunger 205 to fully extend to lock the bar holder from rotating back into the unlatched position.

In an alternate embodiment (not shown) the location of the secondary latch can be placed at the toggle pivot 166 between the two bars, if needed. It is shown at the end of the link extension to keep it out of harms way. As you locate nearer the tip of the door 86, the greater the possibility of seeing material plowing and contamination during use.

The secondary latch 190 is tripped by pulling the trip plunger 205 out of engagement with the bar holder 194. This allows the bar holder 194 to release the tail end 200 of the primary locking mechanism. The weight of the door, and the weight of the material in the dipper which exerts additional weight on the door, produces a rotational moment on the latch jaw forcing it to rotate out of engagement. The linkage system will accommodate the rotation of the latch because the linkage is just short of the toggle point, not at the toggle point, and not beyond the toggle point where it would fail to move. The mechanical stop 202 insures that the mechanism will not reach toggle nor go beyond toggle. When the latch rolls out of engagement, the mechanism collapses and the door opens. Latch rotation out of engagement does not generate any significant sliding friction because the striker bar is allowed to rotate within the bushings that support it in the cradle of the dipper body. The sudden latch rotation results in the sudden release of latch loads that do not have to be resisted by any objects in contact. Sliding friction under large sliding loads is eliminated.

The door 86 falls open releasing the load within the dipper 38. The mechanism is held in the collapsed state by the pair of tension springs 172. This is necessary to hold the latch jaw with the proper orientation for the jaw chin 112 to strike the dipper striker bar 180 upon re-latch. The tension springs mounted uniquely with respect to the mechanism toggle point, therefore, hold the latch jaw in the proper position after unlatching and drive the latch jaw closed upon re-latching. In a less preferred embodiment (not shown), torsional springs could be incorporated at the toggle pin joint to achieve the same behavior.

The addition of the springs 172 to the linkage is an important controlling feature of the mechanism. Without the springs the linkage would not be held in the collapsed position with the latch jaw wide open and ready for re-latch. The springs, one spring located outboard on either side of the bars, serve a dual purpose in that upon re-latch the spring force line of action transfers from one side of the pivot pin to the other side. As the lower latch jaw strikes the dipper striker bar upon re-latch, the spring line of action passes across the pivot and now serves to drive the latch jaw rotation to curl around the striker bar and remain in the latched position.

As the jaw 104 curls around the striker bar 180, the tension spring line of action now acts on the other side of the pivot and "kicks in" and provides impetus to drive the latch 104 into engagement with the striker during re-latch.

The unique rotational dipper door latch does not require the high forces generated by hydraulics to open and close. The rotational dipper door latch uniquely closes under gravity, latches with a positive lock on the dipper striker bar, and requires a relatively small tripping force to unlatch.

The secondary latch in essence, controls the toggle point of this four bar linkage because the bar involved in the toggle is extended away from all the link motion toward the back of the dipper, but sees the same reduced load. The secondary latch therefore takes advantage of the inherent mechanical advantage of a pivot-approaching toggle. Any dry sliding friction loads in the secondary latch are miniscule compared to the original design friction loads in the primary latch arm, and therefore the invention eliminates the maintenance and reliability problems posed by the dry sliding friction.

Third Embodiment

Figure 18:
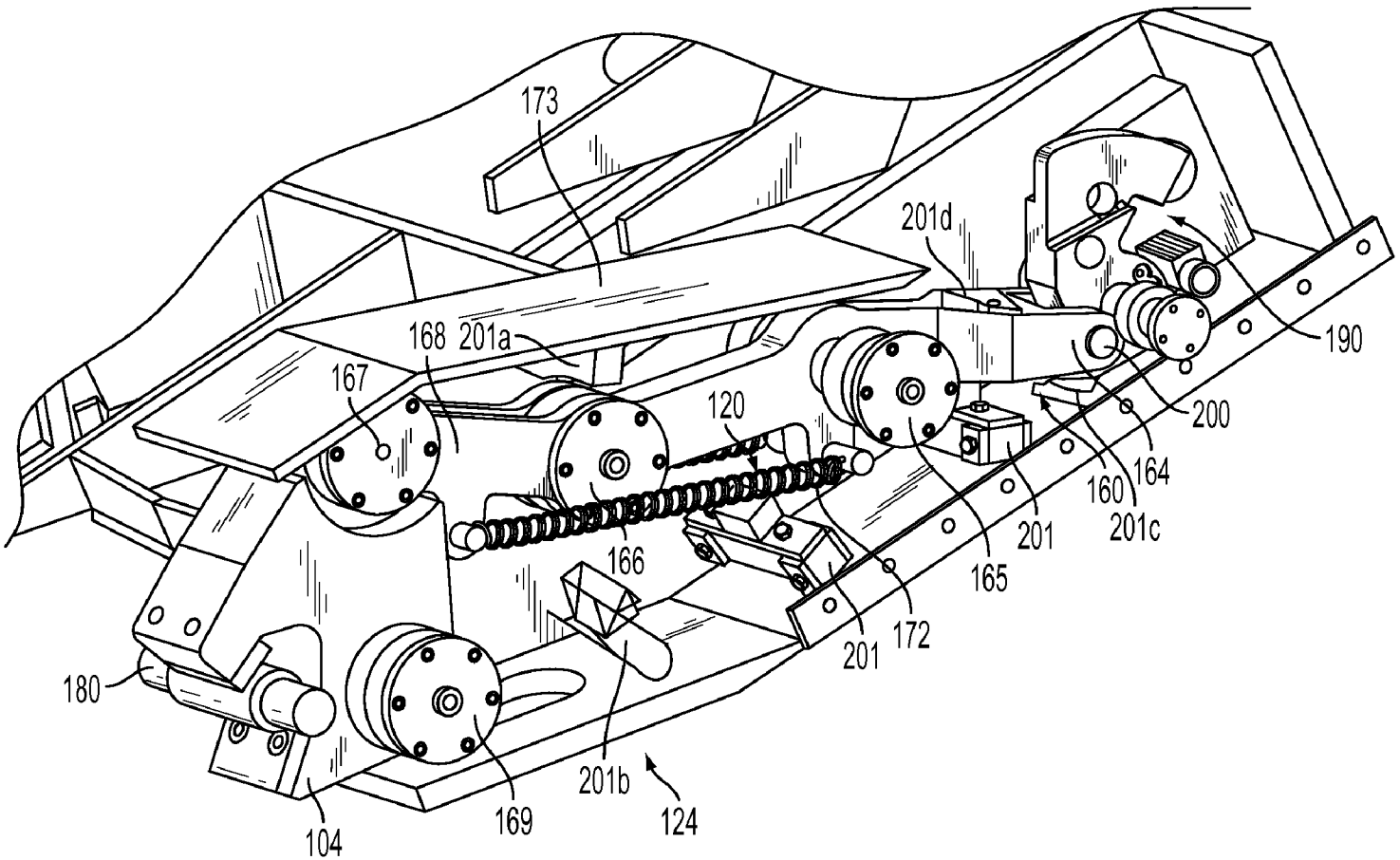
FIG. 18 is a partial broken away side perspective view of yet another embodiment of the latch mechanism of this invention, with the latch in a door-closed position, similar to FIG. 11.

A further and preferred embodiment of the latch mechanism is illustrated in FIG. 18. In this embodiment, additional bumper stops have been added. More particularly, a bumper stop 201*a* has been added to the top protective cover 173, and another bumper stop 201*b* has been added to the dipper door, so that as the pivot connection between the two bars moves, the ends of travel contact the bumper stops 201*a* and 201*b*, and absorb energy within the pivot joint. Furthermore, a bumper stop 201*c* has also been added to the dipper door underneath the bar end 200, and a bumper stop 201*d* has been added to the top of the bar so that, when the bar contacts the upper protective cover 173, energy is absorbed by the bumper stop 201*d*.

Figure 21:
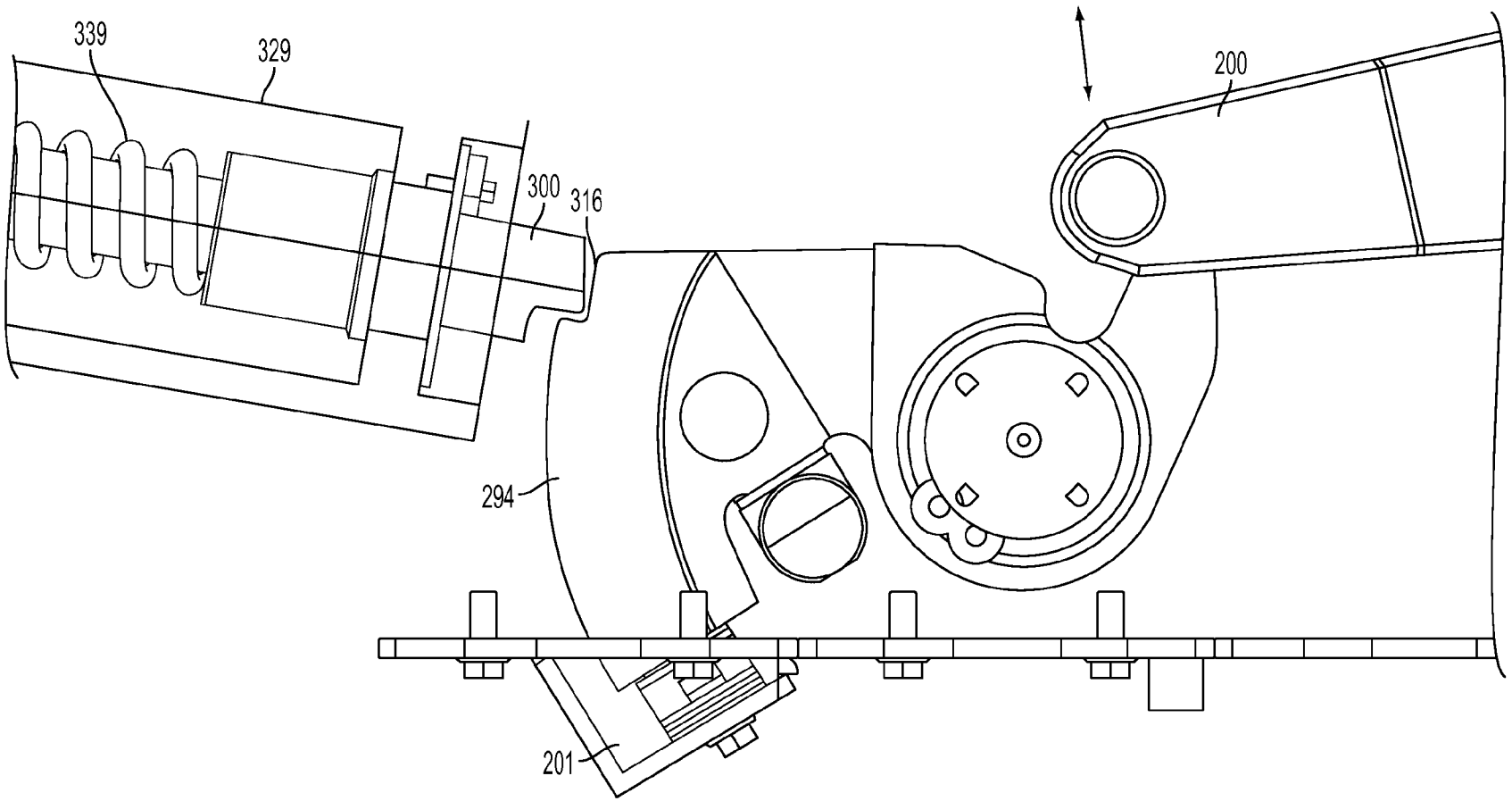
FIG. 21 is a side view of the bar holder shown in FIG. 19, with the added false latch prevention mechanism.

In another and preferred embodiment, the secondary latch mechanism further includes a false latch preventing mechanism 298. More particularly there are times where, when material hits the jaw 104, the latch mechanism may rotate to the latch closed position even though the dipper door 86 has not been closed. In order to prevent this from happening, a plunger 300 has been added located near a bar holder 294, substantially the same as bar holder 194, as illustrated in FIG. 21. The plunger 300 engages a notch 316 on the bar holder 294, when the dipper door is not closed, thus preventing the bar holder 294 from rotating, and preventing the bar end 200 from being secured within the bar holder 294.

Figure 19:
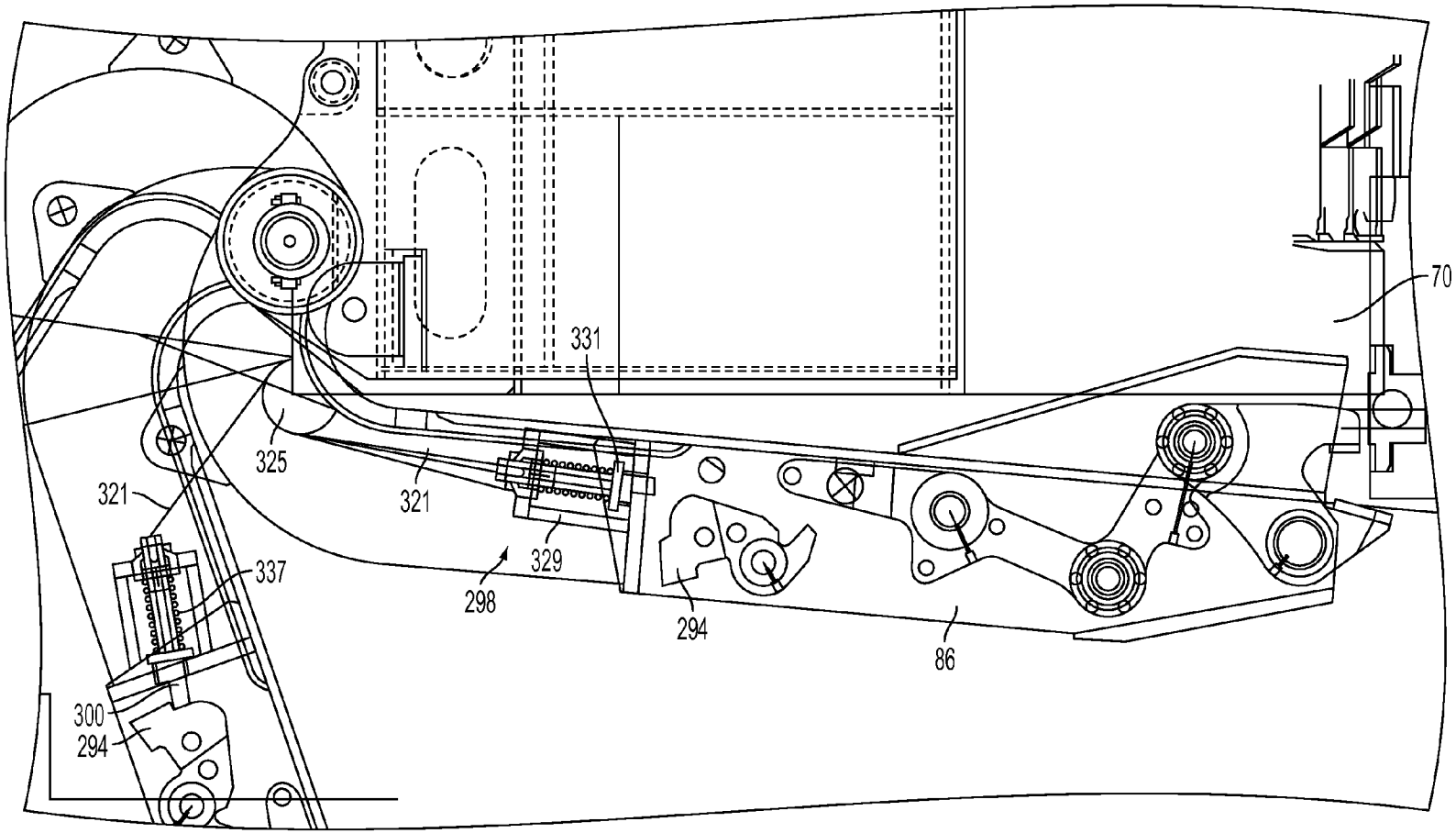
FIG. 19 is a cross sectional view of another embodiment of the latch assembly according to this invention, showing the dipper mounted on the dipper body and in both a near latch and an open position.
Figure 20:
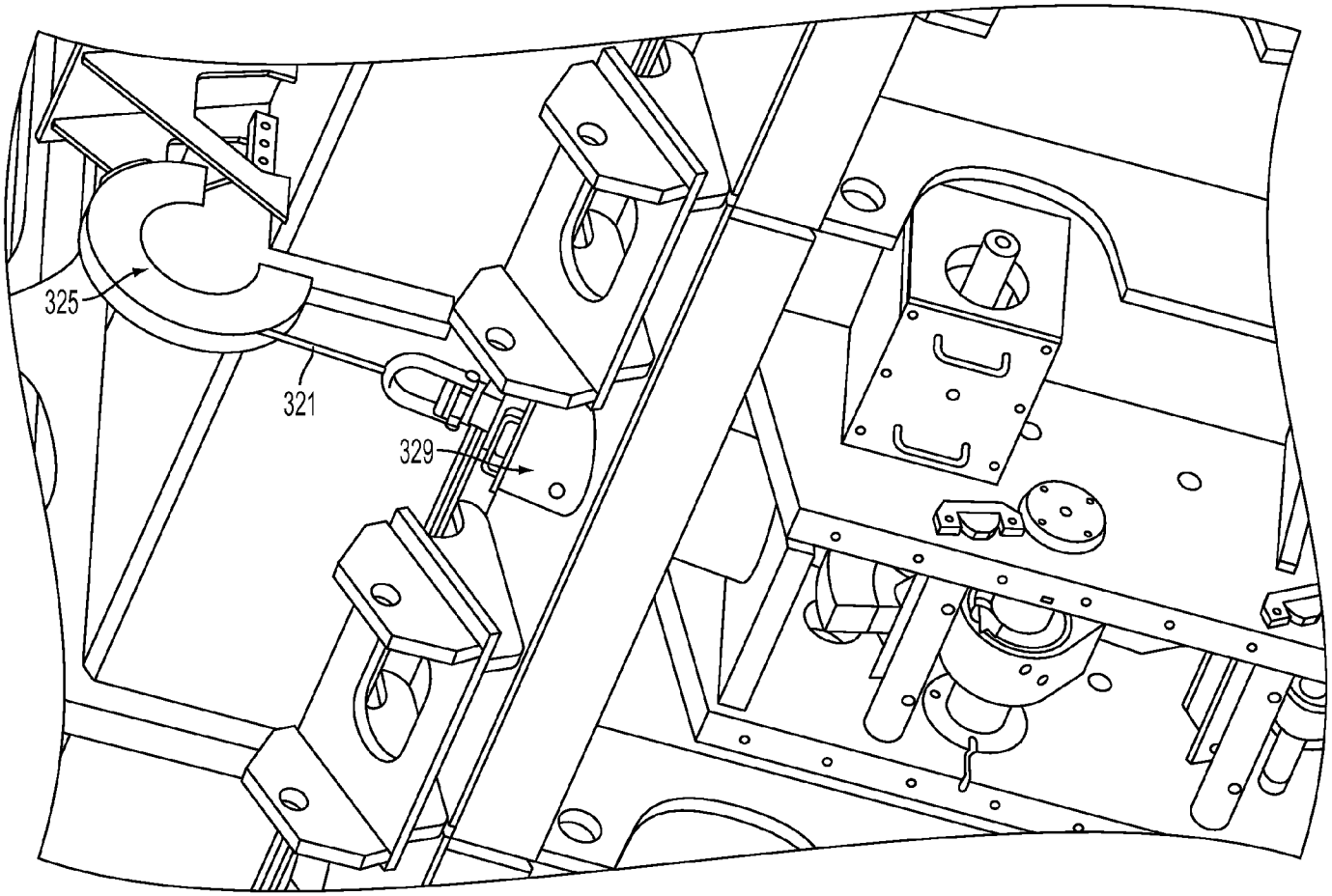
FIG. 20 is a perspective view of the latch assembly shown in FIG. 19, illustrating the added false latch prevention mechanism.

The plunger 300 is connected to a chain 321, as illustrated in FIG. 20. The chain 321 extends from the plunger 300 and around a semi-spherical bracket 325 attached to the dipper body back wall 66. As the door latch approaches the dipper body front wall 70, as shown in FIG. 19, the chain becomes taught, pulling the plunger 300 away from the bar holder 294, and out of the notch 316, thus permitting the bar holder 294 to engage the bar end 200. The plunger 300 is enclosed within a housing 329, and includes a seat 331 located within the housing 329, and a spring 337 located between the seat 331 and the housing 329 that biases the plunger 300 towards its extended position. Thus, when the dipper door 86 is opened, and the chain 321 becomes slack, the spring 337 pushes the plunger 300 toward the bar holder 294, so that the plunger 300 engages the notch 316 on the bar holder 294. In other embodiments (not shown) solid links can be used in place of the chain 321.

Figure 22:
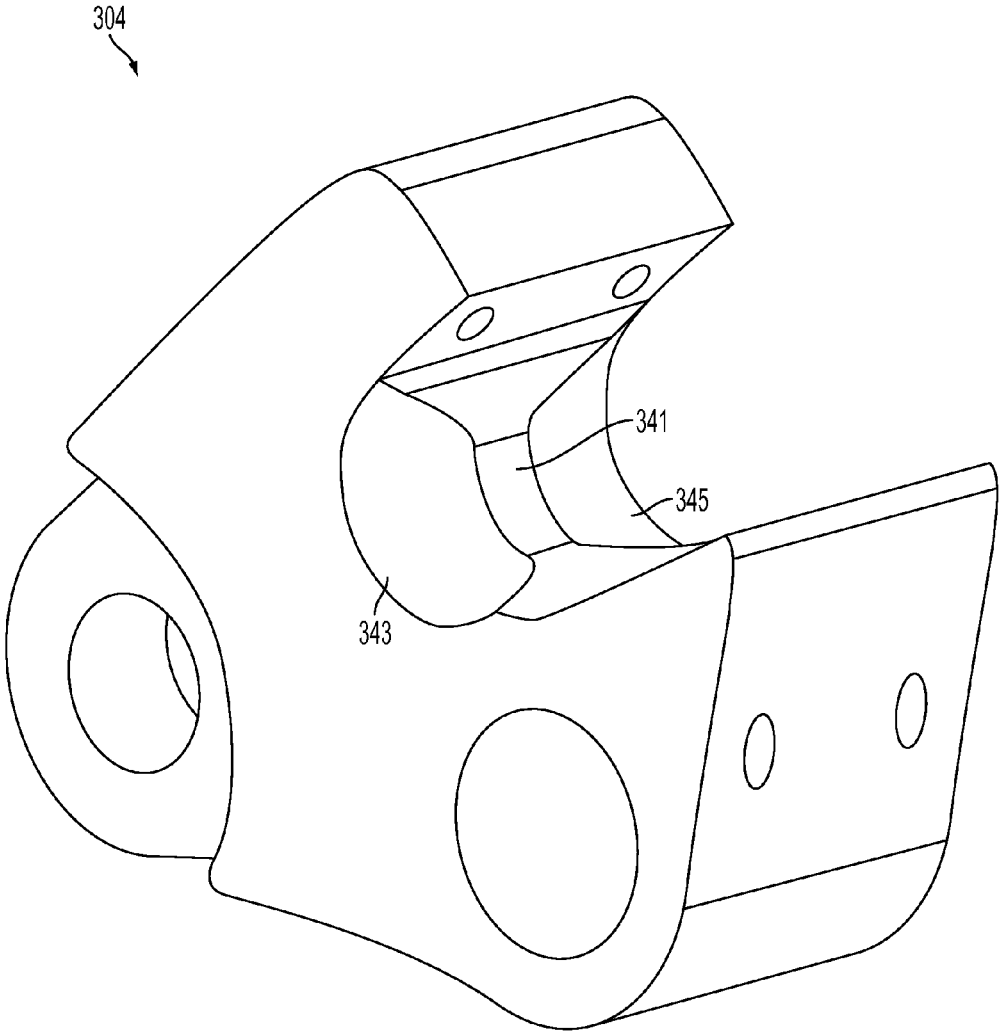
FIG. 22 is a perspective view of the another embodiment of the latch jaw.

In another and preferred embodiment, a jaw 304 similar to the jaw 104 has been modified so that it no longer presents a large flat surface to the striker bar 180. More particularly, as illustrated in FIG. 22, the jaw mouth surface engaging the striker bar 180 now includes a relatively small central flat portion 341, and side portions 343 and 345 that angle away from the flat portion 341. This permits any dirt that may come into contact with the jaw 304 to then fall away from the jaw 304. This prevents significant dirt from remaining inside the jaw 304, and interfering with the interaction between the jaw 304 and the striker bar 180.

Figure 23A:
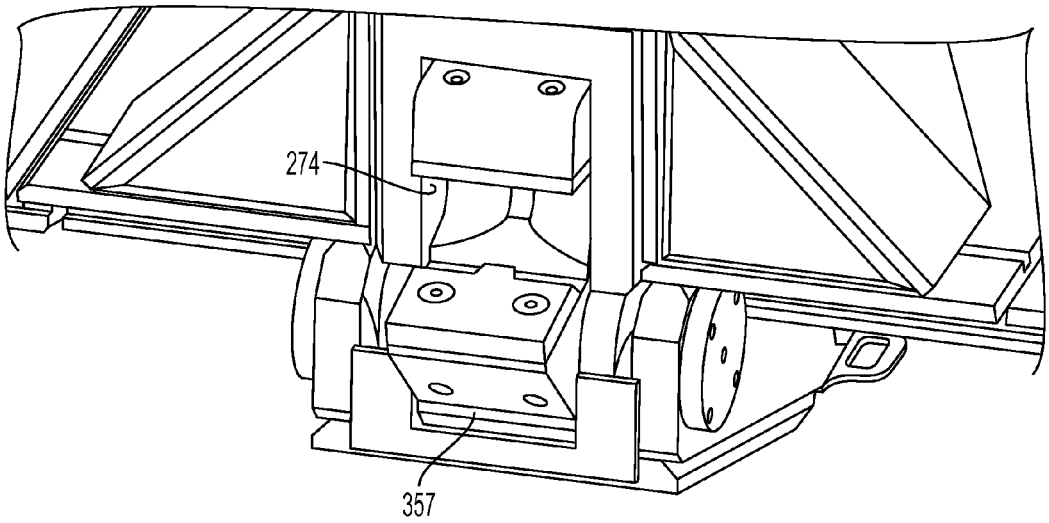
FIGS. 23A and 23B are perspective views of the jaw mounted in a jaw housing, with the jaw shown in its open and closed positions.
Figure 23B:
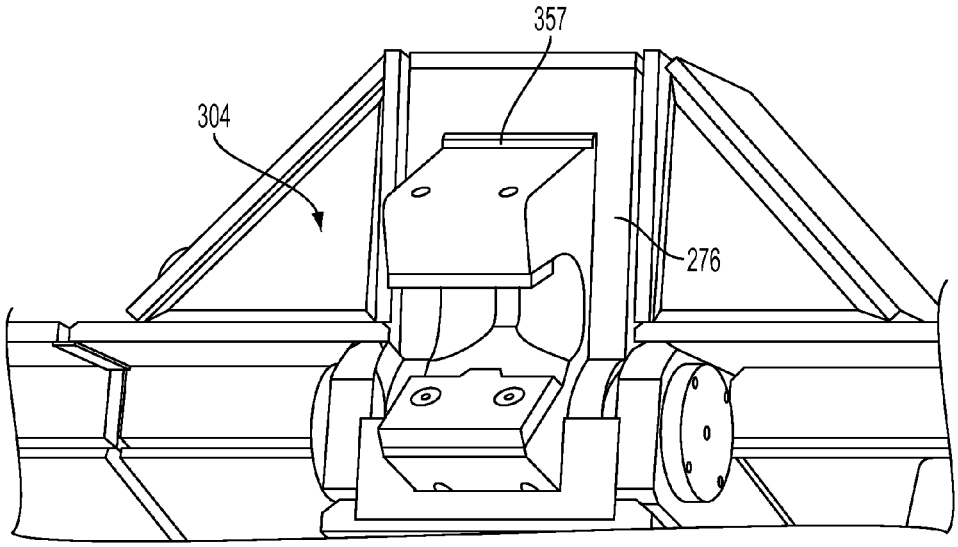

In another embodiment, as illustrated in FIGS. 23A and 23B, the jaw 304 is held within an opening 274 in a housing 276 closely adjacent to the jaw 304. Mounted on the jaw lip and chin, on the radially outward outside surfaces, are wipers 357. The wipers 357 contact the jaw housing 276, and assist in the prevention of dirt coming into the jaw housing 276, and assist in removing any dirt that does come into the jaw housing 276.

Figure 24:
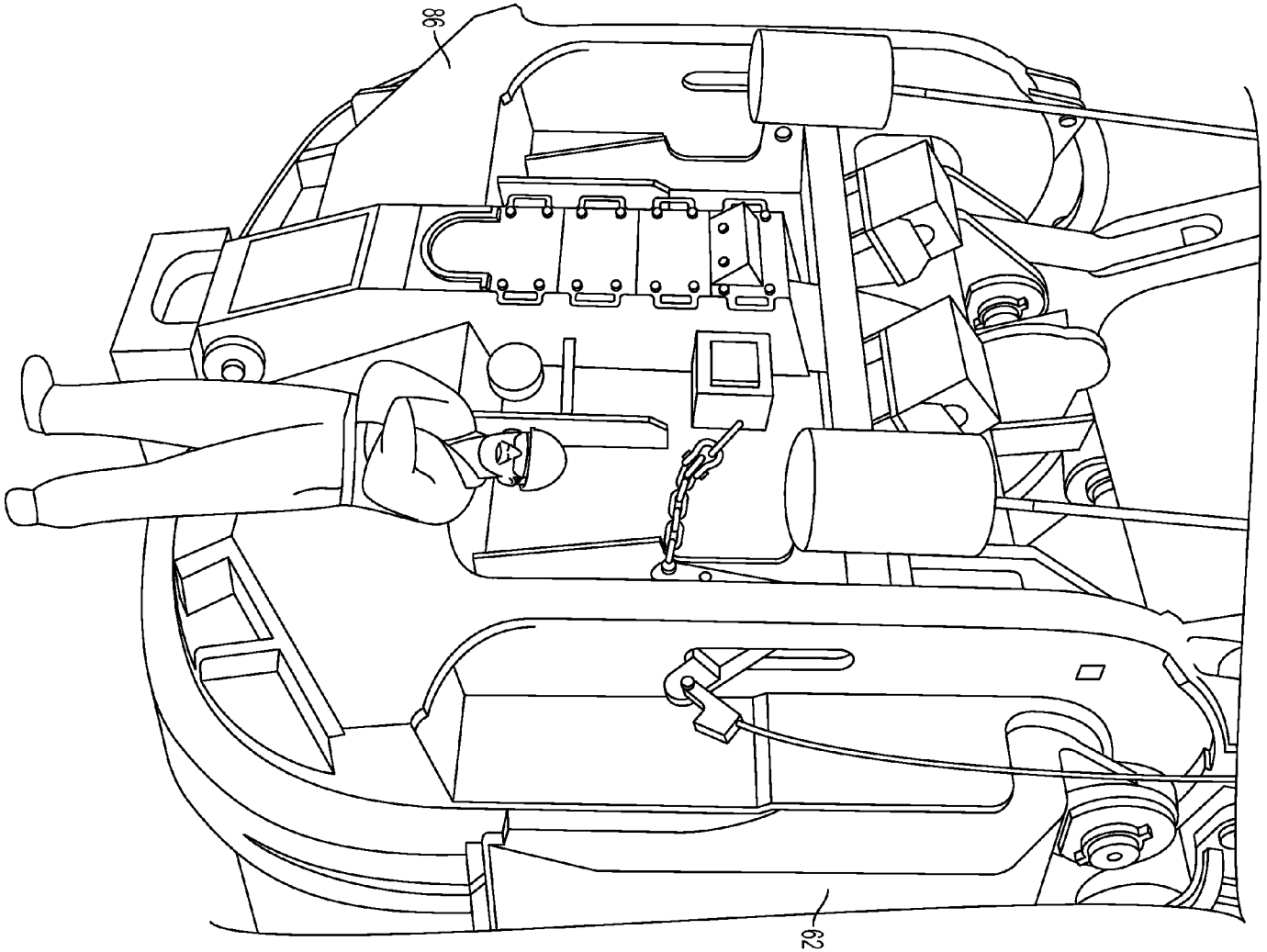
FIG. 24 is a perspective view illustrating the massive size of the dipper and dipper door relative to a person.

FIG. 24 illustrates the relative size and complexity of the dipper door 86 mounted on the dipper body 62, as compared to the size of a person. As is readily apparent, the latching of such a massive structure is substantially more complex than the latching of simpler doors.

Various features of the invention are set forth in the following claims.

The invention claimed is:

1. A dipper adapted to be connected to a power shovel handle for movement therewith, said dipper having a dipper body defining a material receiving opening and a material discharging opening, said dipper body having a latch receiving opening adjacent one end of said discharging opening, said dipper further including a dipper door mounted on said dipper body adjacent an opposite end of said discharging opening for pivotal movement relative to said dipper body between a closed position and an opened position, and an impact actuated jaw having a "C" shape defining a lip and a chin, said jaw being rotatably mounted on said dipper door for rotation between a door-opened position and a door-closed position and positioned so that, when said jaw is in the door-opened position, said jaw chin can be impacted by the dipper body when the door pivots to the door-closed position, and so that impact by the dipper body on the chin rotates said jaw into the door-closed position where said jaw lip is in said latch opening and prevents door opening.

2. A dipper in accordance with claim 1 wherein said dipper body has a cutout adjacent said one end of said discharging opening, and a striker bar attached to said dipper body and extending across said cutout parallel to the plane of said dipper discharging opening, said latch receiving opening being defined by said striker bar and said cutout, and wherein said jaw chin impacts said striker bar.

3. A dipper in accordance with claim 1 wherein said striker bar is rotatable relative to said dipper body.

4. A dipper in accordance with claim 1 wherein said dipper further includes a hold open mechanism for releasably holding said jaw in said door-opened position when said jaw is in said open position, and a locking mechanism for releasably locking said jaw when said jaw is in said door-closed position.

5. A dipper in accordance with claim 4 wherein when the locking mechanism is released said latch rotates open as a result of the weight of the door and the material pushing against the dipper door.

6. A dipper in accordance with claim 4 wherein said locking mechanism is a hydraulic cylinder assembly pivotally attached to and extended between said dipper door and said latch.

7. A dipper in accordance with claim 6 wherein said dipper door includes spaced apart structural support ribs.

8. A dipper in accordance with claim 7 wherein said jaw is rotatably mounted between two of said support ribs.

9. A dipper in accordance with claim 8 wherein said cylinder assembly is pivotally attached at one end between two of said support ribs.

10. A dipper in accordance with claim 6 wherein said locking mechanism includes a closed loop hydraulic circuit in communication with said hydraulic cylinder assembly.

11. A dipper in accordance with claim 10 wherein said closed loop hydraulic circuit includes at least one check valve, a locking valve and at least one accumulator.

12. A dipper in accordance with claim 11 wherein said locking valve can be closed to prevent fluid flow through the hydraulic circuit, thus locking the locking mechanism.

13. A dipper in accordance with claim 11 wherein said locking mechanism is unlocked by opening said locking valve.

14. A dipper in accordance with claim 11 wherein said bypass circuit further includes a heat sink.

15. A dipper in accordance with claim 6 wherein when the dipper door is latched the jaw is biased to rotate to release from the latch opening but is held in place by the hydraulically locked cylinder assembly.

16. A dipper in accordance with claim 6 wherein said hold open mechanism comprises said at least one accumulator that provides residual pressure that extends the cylinder assembly to its maximum extension.

17. A dipper in accordance with claim 6 wherein the cylinder assembly is fully retracted when the jaw is in its door-closed position.

18. A dipper in accordance with claim 6 wherein said cylinder assembly includes a cylinder and a piston rod received in the cylinder, and wherein said piston includes an internal check valve.

19. A dipper adapted to be connected to a power shovel handle for movement therewith, said dipper having a dipper body defining a material receiving opening and a material discharging opening, said dipper body having a latch receiving opening adjacent one end of said discharging opening, said dipper further including a dipper door mounted on said dipper body adjacent an opposite end of said discharging opening for pivotal movement relative to said dipper body between a closed position and an opened position;

a latch pivotally mounted on said dipper door for pivotal movement between a door-opened position and a door-closed position, and positioned so that when said latch is in the door-opened position, said latch is not in said latch opening, and when in said door-closed position, said latch is in said latch opening and prevents door-opening, a hold open mechanism for releasably holding said door latch in said latch open position when said latch is in said open position, and a locking mechanism for releasably locking said latch when said latch is in said door-closed position, said locking mechanism including one bar pivotally attached to the door, and another bar pivotally connected to and extending between each of the one bar and the latch.

20. A dipper in accordance with claim 19 wherein said latch is a "C" shaped jaw.

21. A dipper in accordance with claim 19 wherein said hold open mechanism is means biasing the latch into the open position.

22. A dipper in accordance with claim 21 wherein said means biasing the latch into its open position is a spring.

23. A dipper in accordance with claim 22 wherein said spring is attached between the one bar and the connecting bar.

24. A dipper in accordance with claim 23 wherein said pivot connection between the one bar and the connecting bar travels over the spring.

25. A dipper in accordance with claim 21 wherein said means biasing the latch into its open position also holds the latch in the locked position.

26. A dipper in accordance with claim 19 wherein said locking mechanism is locked by impact of one bar end into a secondary latch.

27. A dipper in accordance with claim 26 wherein said secondary latch comprises a bar holder pivotally mounted on said dipper door, said bar holder having a bar holding indentation, said indentation receiving said one bar end and preventing movement of said one bar end when in a bar holding position and permitting movement of said one bar end when in a bar releasing position.

28. A dipper in accordance with claim 27 and further including means biasing said bar holder toward an unlocked position but is held in locked position by a plunger.

29. A dipper in accordance with claim 28 wherein said means biasing said bar holder also aids holding the latch in the bar holding position.

30. A dipper in accordance with claim 27 wherein the secondary latch is biased toward the bar releasing position but is held in its bar holding position by a plunger.

31. A dipper in accordance with claim 30 wherein said plunger presses against said secondary latch and then slips into position when the secondary latch rotates out of the plunger's way.

32. A dipper in accordance with claim 31 wherein said plunger is biased toward secondary latch by a compression spring.

33. A dipper in accordance with claim 19 wherein, when the locking mechanism is released, said latch rotates open as a result of the weight of the door and the material pushing against the dipper door.

34. A dipper in accordance with claim 19 wherein said dipper body has a cutout adjacent said one end of said discharging opening, and a striker bar attached to said dipper body and extending across said cutout parallel to the plane of said dipper discharging opening, said latch receiving opening being defined by said striker bar and said cutout, and wherein said jaw chin impacts said striker bar.

35. A dipper in accordance with claim 34 wherein said striker bar is rotatable relative to said dipper body.

36. A dipper in accordance with claim 19 wherein said dipper door includes spaced apart structural support ribs.

37. A dipper in accordance with claim 36 wherein said jaw is rotatably mounted between two of said support ribs.

38. A dipper in accordance with claim 37 wherein said latch, hold open mechanism and locking mechanism is located between two of said support ribs.

39. A dipper in accordance with claim 19 wherein said Said latch further includes a first bumper stop adjacent one side of the pivotal connection of the one bar to the other bar, and a second bumper stop adjacent to the other side of the pivotal connection of the one bar to the other bar.

40. A dipper in accordance with claim 19 wherein said latch includes a "C" shaped jaw having a lip and a chin, and wherein said jaw has a mouth having a width, and wherein said mouth has a central dipper body engaging surface narrower then said mouth width, and outer surfaces that angle away from said dipper door latch receiving opening.

41. A dipper in accordance with claim 19 wherein said jaw is mounted within a housing, and wherein said jaw includes radially outward wipers on said jaw outer surface, said wipers extending between said jaw outer surface and said housing.

42. A dipper adapted to be connected to a power shovel handle for movement therewith, said dipper having a dipper body defining a material receiving opening and a material discharging opening, said dipper body having a latch receiving opening adjacent one end of said discharging opening, said dipper further including a dipper door mounted on said dipper body adjacent an opposite end of said discharging opening for pivotal movement relative to said dipper body between a closed position and an opened position;

a latch pivotally mounted on said dipper door for pivotal movement between a door-opened position and a door-closed position, and positioned so that when said latch is in the door-opened position, said latch is not in said latch opening, and when in said door-closed position, said latch is in said latch opening and prevents door-opening, a hold open mechanism for releasably holding said door latch in said latch open position when said latch is in said open position, and a locking mechanism for releasably locking said latch when said latch is in said door-closed position, said locking mechanism including a secondary latch comprising a bar holder pivotally mounted on said dipper door, one bar pivotally attached to the door, another bar pivotally connected to and extending between each of the one bar and the latch, said locking mechanism being locked by impact of one bar end into a secondary latch, said secondary latch, said bar holder having a bar holding indentation, said indentation receiving said one bar end and preventing movement of said one bar end when in a bar holding position and permitting movement of said one bar end when in a bar releasing position, and a false latching preventing mechanism mounted on said dipper door and extending between said dipper body and said dipper door, said false latching preventing mechanism preventing movement of said bar holder from a bar releasing position to a bar holding position when the dipper door is pivoted open, and permitting movement of said bar holder to a bar holding position when said dipper door is near a dipper door closed position.

43. A dipper in accordance with claim 42 wherein said false latching preventing mechanism comprises a plunger mounted in a housing on said dipper door, adjacent said bar holder, a notch on said bar holder that receives said plunger, and a link mechanism between said plunger and said dipper body that retracts said plunger away from said bar holder when said dipper door is near a dipper door closed position, and biasing means between said plunger housing and said plunger that extends said plunger into said bar holder notch when said dipper door is pivoted open.

* * * * *

UNITED STATES PATENT AND TRADEMARK OFFICE

CERTIFICATE OF CORRECTION

PATENT NO. : 8,136,272 B2
APPLICATION NO. : 12/684883
DATED : March 20, 2012
INVENTOR(S) : William J. Hren et al.

It is certified that error appears in the above-identified patent and that said Letters Patent is hereby corrected as shown below:

In claim 39, column 13, line 64, "said Said" should be --said--.

Signed and Sealed this
Twenty-fifth Day of September, 2012

David J. Kappos

David J. Kappos
*Director of the United States Patent and Trademark Office*